United States Patent [19]

Allen et al.

[11] 4,378,645

[45] Apr. 5, 1983

[54] SPREADER FEEDER APPARATUS

[75] Inventors: William W. Allen, Plantation; Alvin G. Lundquist, Jr., Fort Lauderdale, both of Fla.

[73] Assignee: Jensen Corporation, Fort Lauderdale, Fla.

[21] Appl. No.: 272,315

[22] Filed: Jun. 10, 1981

[51] Int. Cl.[3] ..... D06F 67/04

[52] U.S. Cl. ..... 38/8

[58] Field of Search ..... 38/143, 8; 271/275, 271/277, 268; 26/87; 198/464, 465; 226/172, 174, 178

[56] References Cited

U.S. PATENT DOCUMENTS

| | | | |
|---|---|---|---|
| 1,925,582 | 9/1933 | Couch | 26/87 |
| 3,376,036 | 4/1968 | Weir | 271/54 |
| 3,664,046 | 5/1972 | Thompson | 38/143 |
| 3,729,846 | 5/1973 | Weir | 38/143 |
| 4,050,173 | 9/1977 | Olsen | 38/143 |
| 4,106,227 | 8/1978 | Allen et al. | 38/143 |

FOREIGN PATENT DOCUMENTS

| | | | |
|---|---|---|---|
| 7411742 | 12/1974 | Netherlands | 38/8 |

*Primary Examiner*—Henry Jaudon

*Assistant Examiner*—Andrew M. Falik

*Attorney, Agent, or Firm*—Oltman and Flynn

[57] ABSTRACT

An apparatus for spreading laundry flatwork pieces, such as bed sheets, before feeding them to subsequent processing equipment, such as an ironer and a folder. The flatwork pieces are spread apart by pairs of clamps, there normally being one pair of clamps at the left end, another pair of clamps at the right end, and a third pair of clamps at the center of the apparatus. The spread-out flatwork pieces are blown onto a conveyor for conveying them to the subsequent processing apparatus. Trailing edge sensors are positioned at different levels below the clamps to sense the upward passage of the bottom edge of the laundry flat piece deposited on the conveyor, and a selector switch enables one of the sensors and disables the other, depending upon the speed at which the conveyor is being operated. Proximity switches sense the positions of the clamps. There is an overlying conveyor cooperating with the main conveyor for sandwiching the laundry flat piece as it is moved into the apparatus for stretching purposes. The main conveyor can be moved to an extended position beyond the clamps to facilitate hand feeding of small laundry flat pieces without engagement by the clamps.

29 Claims, 27 Drawing Figures

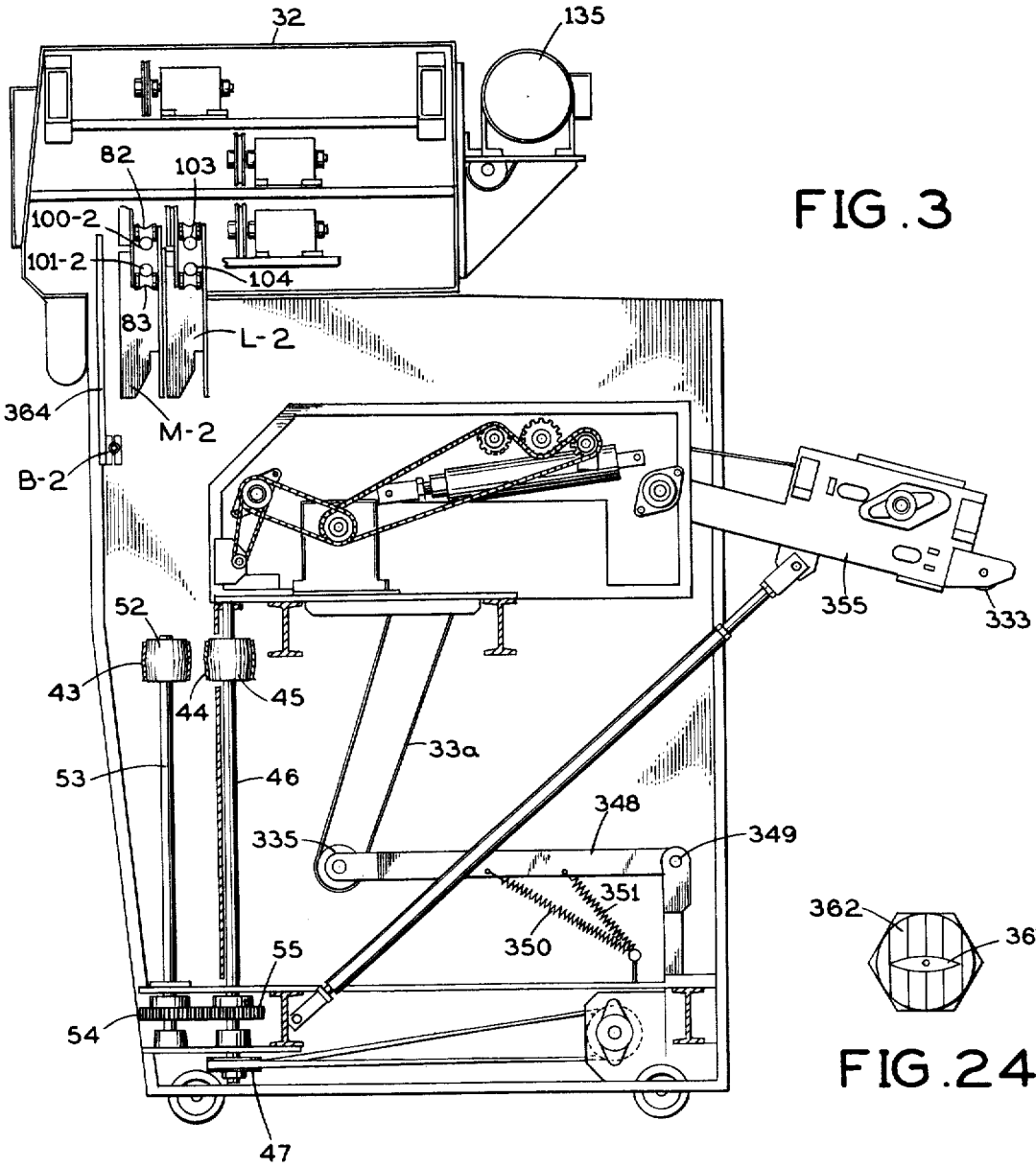
FIG. 3
FIG. 24
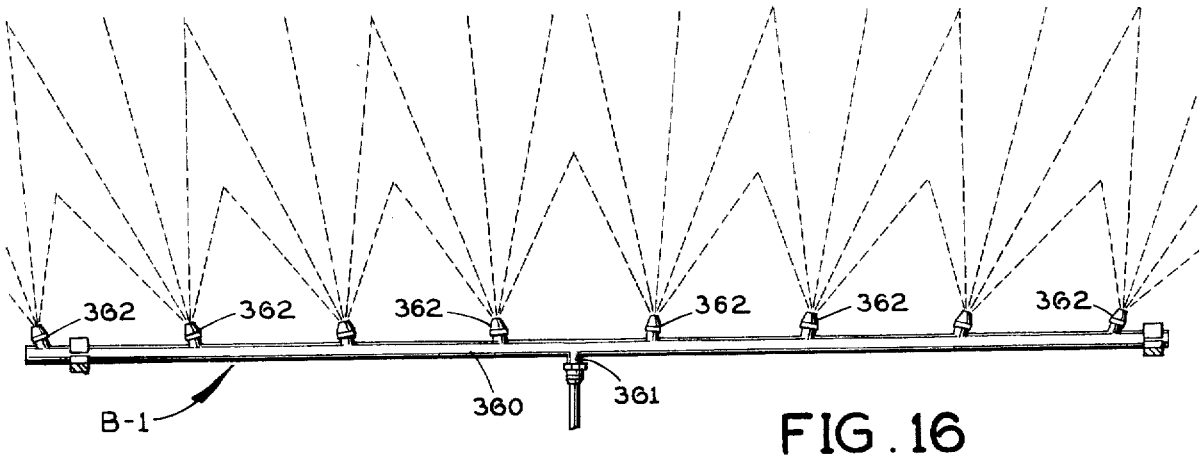
FIG. 16

SPREADER FEEDER APPARATUS

BACKGROUND OF THE INVENTION

This invention relates to an apparatus for spreading and feeding laundry flat work pieces before feeding them to subsequent processing equipment.

U.S. Pat. No. 4,106,227 assigned to the present assignee discloses a spreader feeder apparatus for spreading laundry flatwork pieces before feeding them to subsequent processing equipment. Separate pairs of flatwork clamps are normally located respectively at the left end, middle and right end of the apparatus. The left end and right end clamps are movable straight across the entry side of the apparatus to the middle before being spread apart. The paired clamps operate to spread their respective flatwork pieces in the order in which their respective start switches are operated manually. Interference among the paired clamps or between clamps of each pair is prevented. No intermediate flatwork transfer operation is required between the insertion of a flatwork piece into a pair of clamps and the spreading of that flatwork piece.

SUMMARY OF THE INVENTION

The apparatus is for spreading laundry flatwork pieces, such as bed sheets, before feeding them to subsequent processing equipment, such as an ironer and a folder. The flatwork pieces are spread apart by pairs of clamps, there normally being one pair of clamps at the left end, another pair of clamps at the right end, and a third pair of clamps at the center of the apparatus. The spread-out flatwork pieces are blown onto a conveyor for conveying them to the subsequent processing apparatus. Trailing edge sensors are positioned at different levels below the clamps to sense the upward passage of the bottom edge of the laundry flat piece deposited on the conveyor, and a selector switch enables one of the sensors and disables the other, depending upon the speed at which the conveyor is being operated. Proximity switches sense the positions of the clamps. There is an overlying conveyor cooperating with the main conveyor for sandwiching the laundry flat piece as it is moved into the apparatus for stretching purposes. The main conveyor can be moved to an extended position beyond the clamps to facilitate hand feeding of small laundry flat pieces without engagement by the clamps. Spreader belts spread the laundry flat piece laterally, and the spreader belts have outwardly projecting bristles for engaging the laundry flat piece very effectively. A safety switch is associated with each pair of spreader belts to detect the presence between them of a foreign object, and the spreader belts are stopped in response to the actuation of either safety switch. Air discharge pipes are provided with nozzles for discharging vertically narrow, horizontally thin-shaped laterally diverging streams of air which merge with each other to form a continuous blanket of air flowing above the conveyor.

Accordingly, it is a general object of the invention to increase the efficiency and convenience of operation of a spreader feeder apparatus.

Another object of the invention is to provide improved safety features in a spreader feeder apparatus.

A further object of the invention is to provide a spreader feeder apparatus capable of operating at different speeds.

A further object of the invention is to provide a spreader feeder apparatus with an extendable conveyor.

A further object of the invention is to incorporate safety switches with the spreading belts of a spreader feeder apparatus for disabling the belts when a foreign object such as hand is caught between the belts.

Still another object of the invention is to discharge air in a spreader feeder apparatus in a horizontal plane acting substantially like a knife blade.

A further object of the invention is to brush a laundry flatwork piece in a spreader feeder apparatus for improved spreading action.

Another object of the invention is to sandwich a laundry flatwork piece as it moves into the apparatus.

Other objects of this invention will appear from the following description and appended claims, reference being had to the accompanying drawings forming a part of this specification wherein like reference characters designate corresponding parts in the several views.

BRIEF DESCRIPTION OF DRAWINGS

FIG. 3 is a cross-sectional view taken along line 3—3 of FIG. 1;

FIG. 16 is a view of an air discharge pipe included in the apparatus;

FIG. 24 shows an air discharge nozzle included in the apparatus;

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Figure 1:
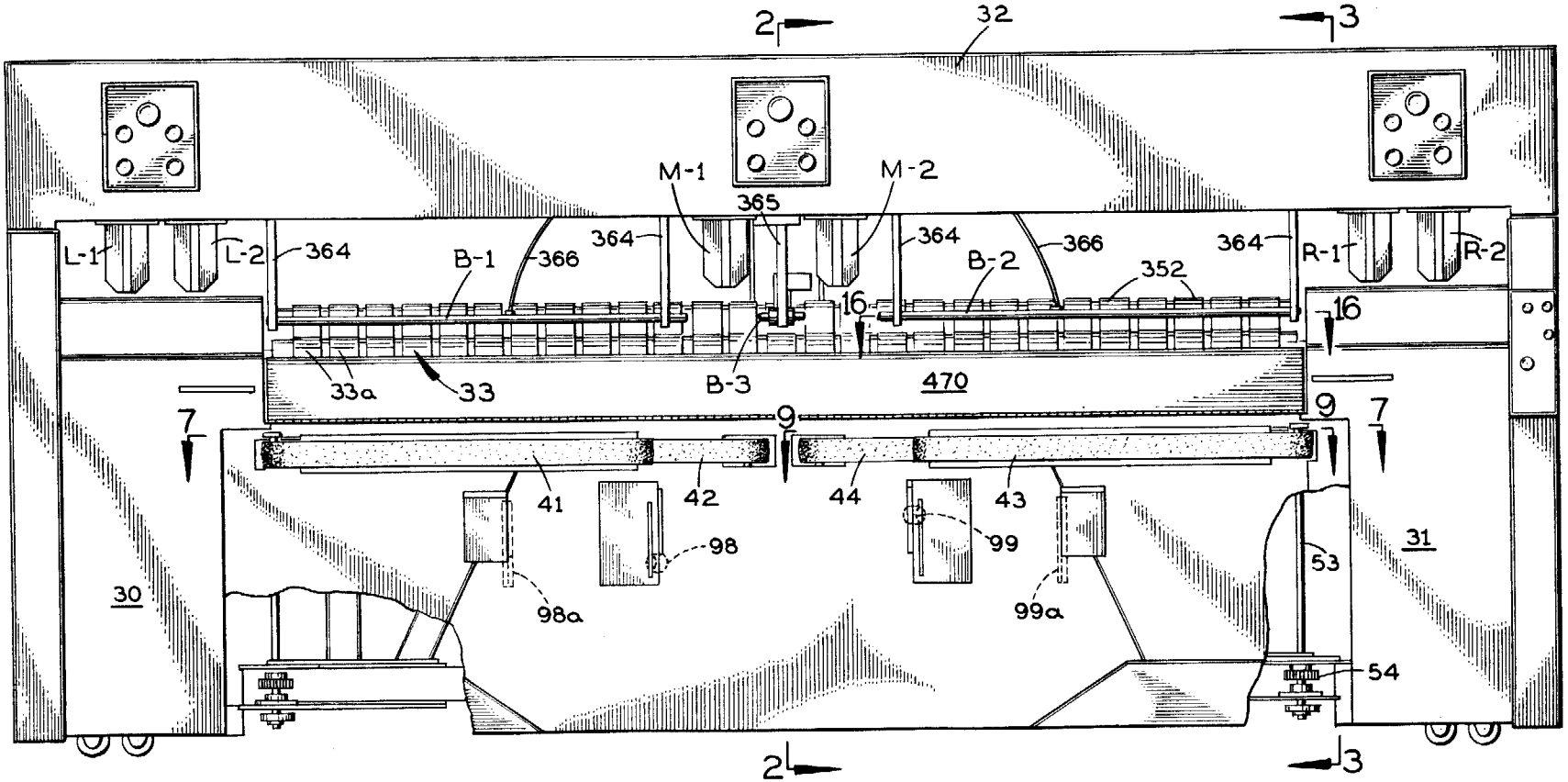
FIG. 1 is a front elevational view of a spreader feeder apparatus in accordance with a preferred embodiment of the invention.

Referring first to FIG. 1, the present apparatus has a framework with laterally spaced, wheel-mounted, upstanding, sheet metal end cabinets 30 and 31 and a horizontally elongated top carriage 32 extending between the end cabinets at the top and slidably adjustable between the normal operating position, shown in full lines in FIG. 8, and a retracted position, shown in phantom in FIG. 8, for a purpose explained hereinafter.

CONVEYOR

A wide, flexible endless belt conveyor 33 is located below the top carriage 32 and extends for almost the complete lateral distance between the upstanding end cabinets 30 and 31. This conveyor has a plurality of laterally spaced, relatively narrow, flexible endless belts 33*a* with upper runs or courses of travel which extend into the apparatus (which for convenience of description will be referred to as the forward direction).

Figures 2, 25:
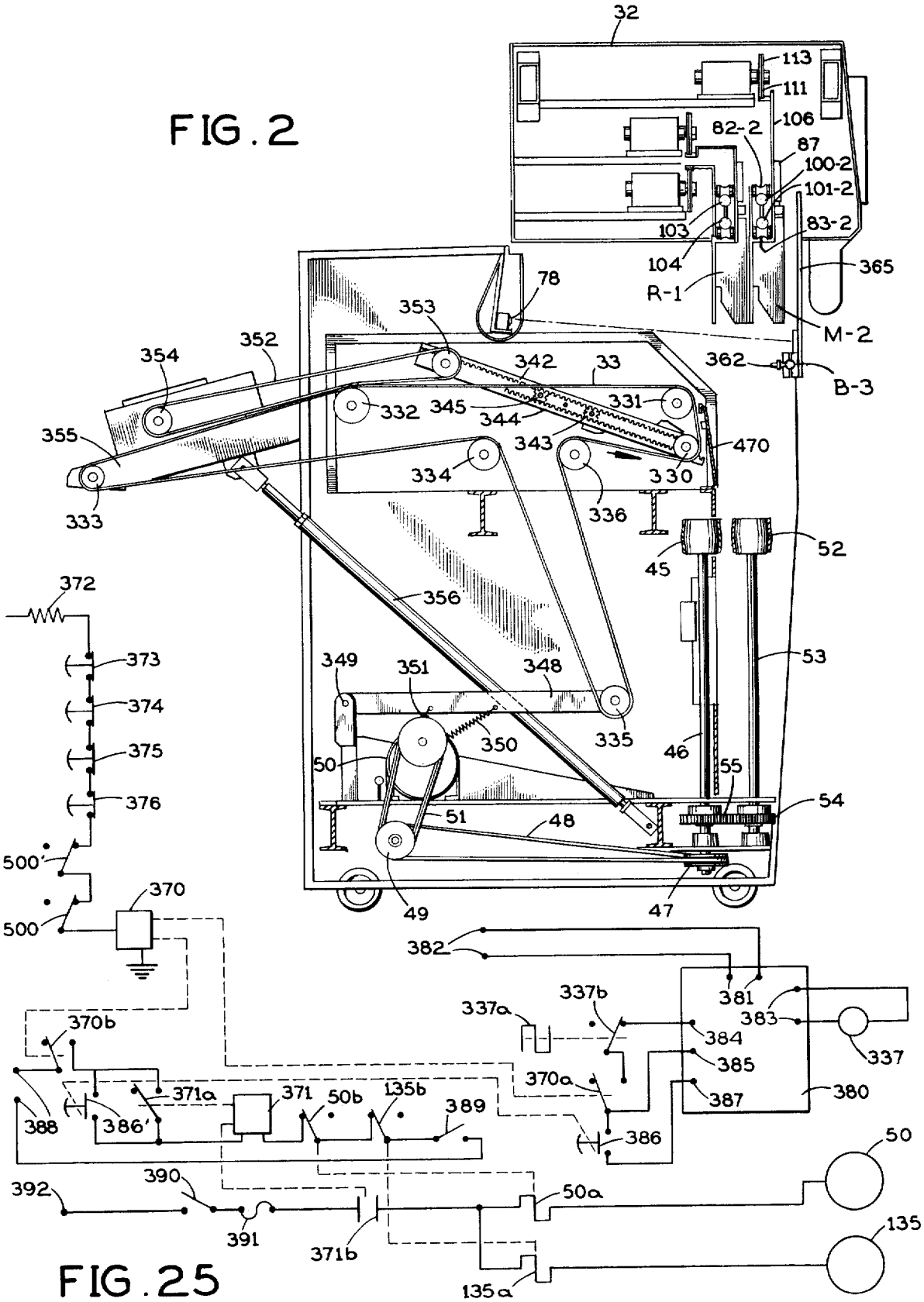
FIG. 2 is a cross-sectional view taken along line 2—2 of FIG. 1.
FIG. 25 is a circuit diagram of an operating circuit for the apparatus.

Referring to FIG. 2, at the entry side of the apparatus the conveyor belts 33*a* extend up across a lower front roller 330 and up across and over an upper front roller 331, passing forward (i.e., into the machine) from roller 331 to an intermediate upper idler roller 332, and forward from the latter to a rear roller 333, passing down across the back of the latter and then back toward the entry side of the machine to an intermediate idler roller 334, and down across the latter to a lowermost roller 335, passing up across the front of the lowermost roller 335 to another intermediate roller 336, and passing up across the top of roller 336 to the roller 330.

The rollers 331, 332, 333, 334 and 336 have stationary axes of rotation. The lower front roller 330 is displaceable from the normal position shown in FIG. 2, where it is almost directly beneath the upper front roller 331, to the extended position shown in FIG. 17, where it projects outward from the machine at its entry side. The lowermost roller 335 is displaceable from the normal, lowered position shown in FIG. 1 to the raised position shown in FIG. 17.

Figure 4:
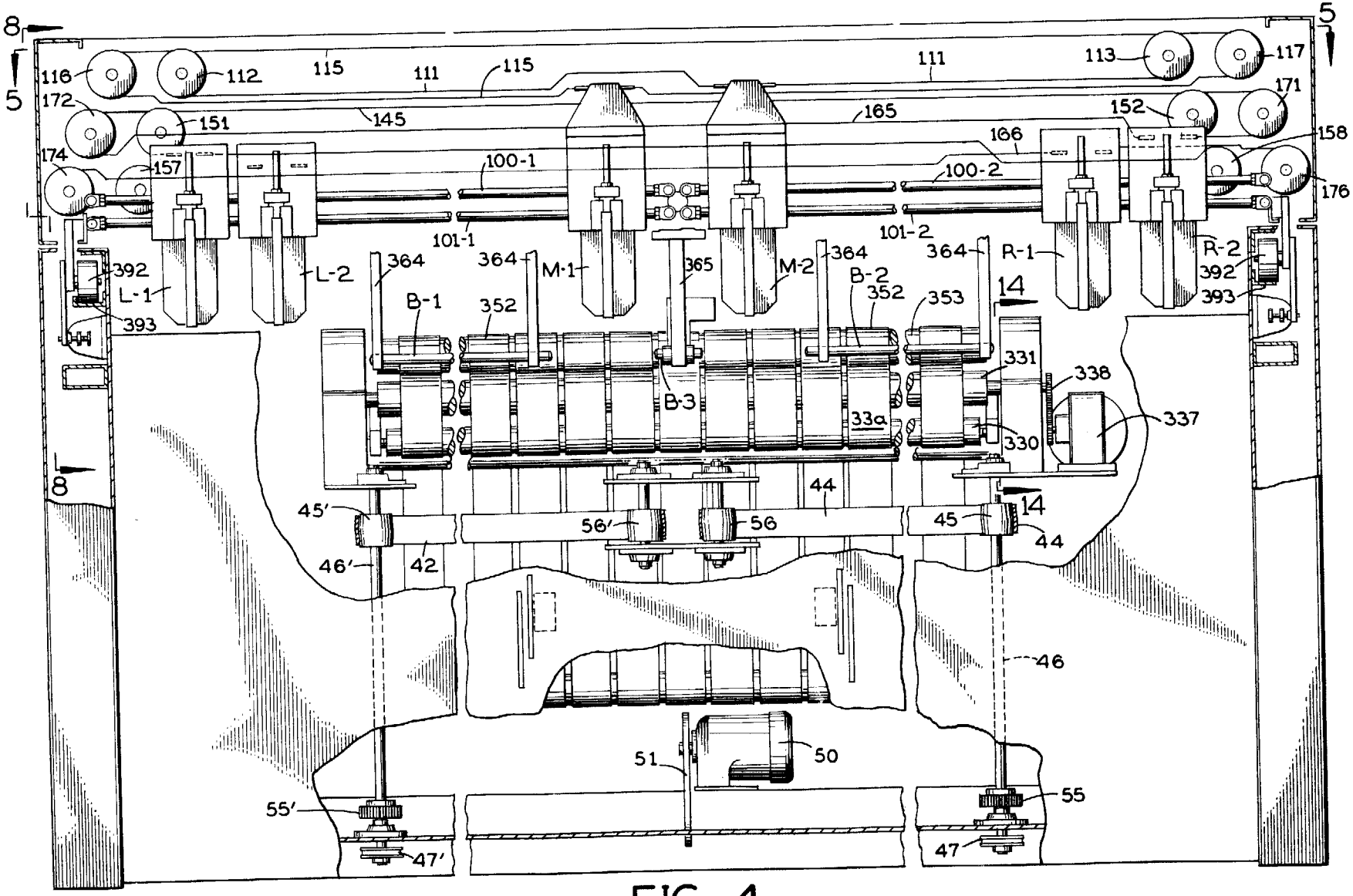
FIG. 4 is a fragmentary view of the front of the apparatus.

The upper front roller 331 is driven from an electric motor 337 (FIG. 4) through a gear reduction 338. The motor 337 is located at the right side of the machine, viewed from its entry side as shown in FIG. 4. Rollers 332 and 353 are also driven. The other rollers 330, 333, 334, 335 and 336 for the conveyor belts 33*a* are idler rollers. The motor drive to the upper front roller 331 and rollers 332 and 353 is in a direction to move the conveyor belts 33*a* from right to left in FIG. 2 across the top of the roller 331 over to the intermediate upper roller 332. Thus, the upper run of the conveyor is into the machine (i.e., "forward" away from the entry side of the machine), and the lower return run of the conveyor is "rearward" from the interior of the machine to its entry side.

Figure 17:
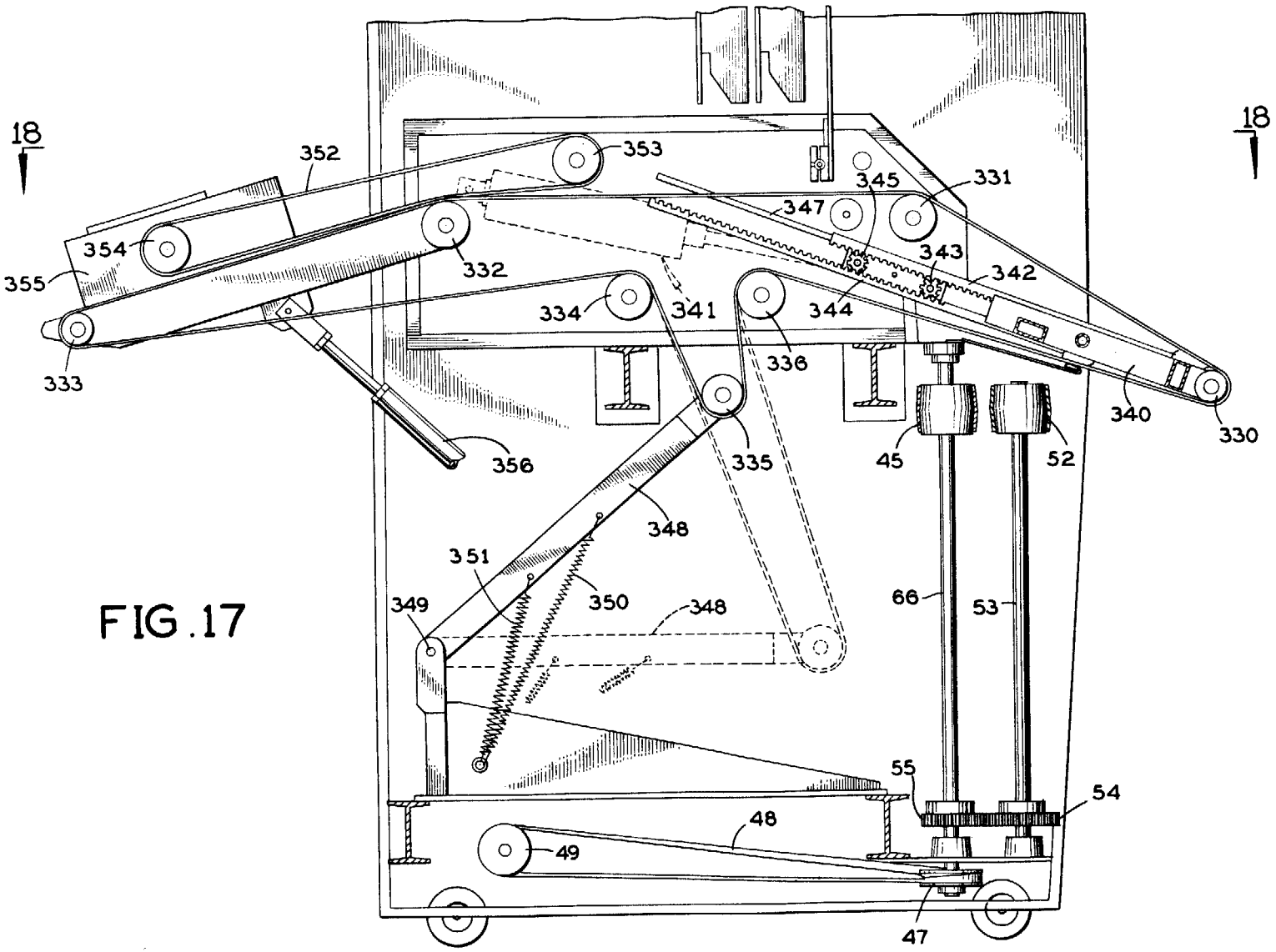
FIG. 17 is a somewhat schematic view of the apparatus illustrating changed positions of the conveyor.
Figure 18:
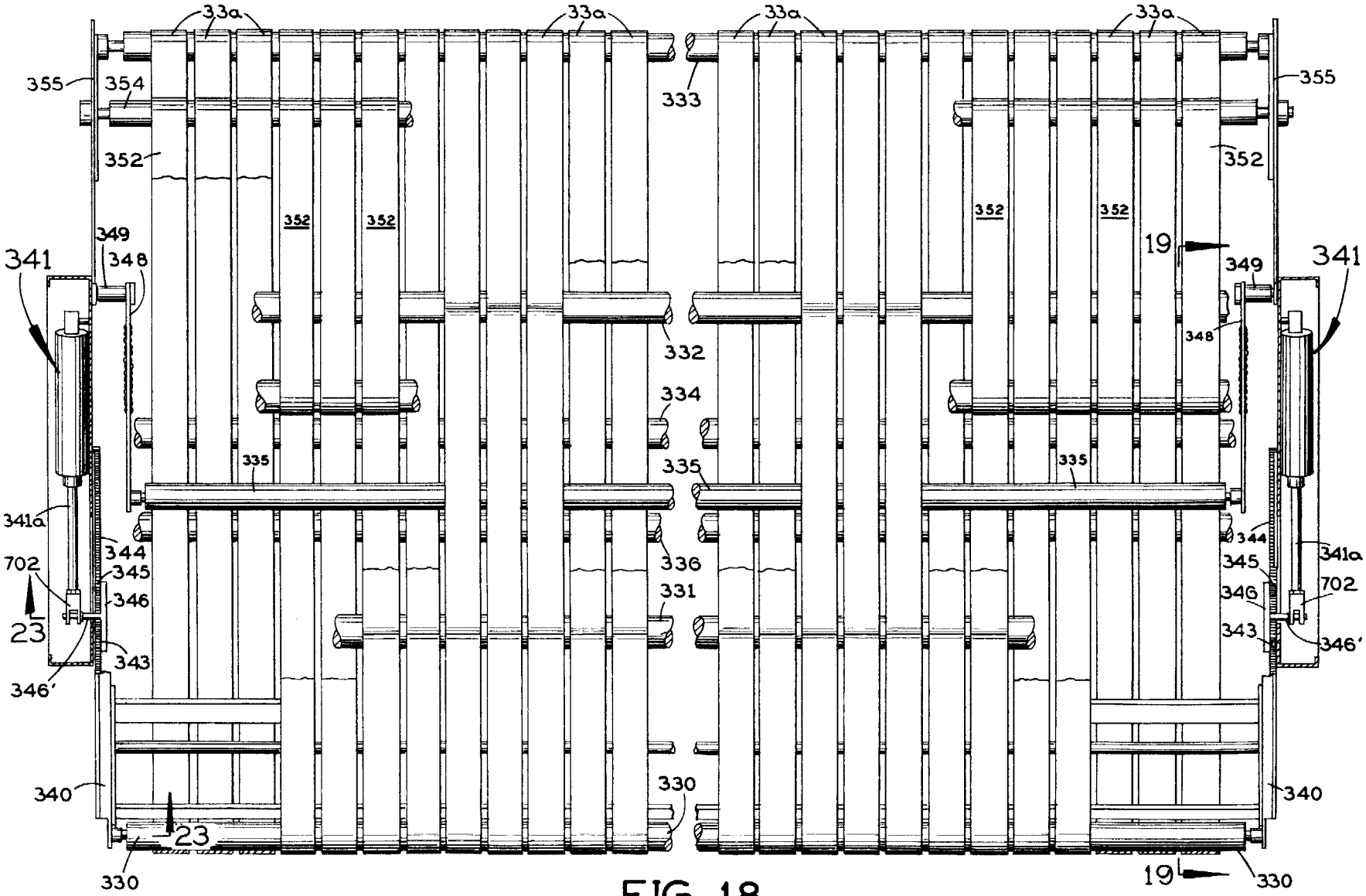
FIG. 18 is a cross-sectional view taken along line 18—18 of FIG. 17.

Referring to FIG. 18, at each end the lower front roller 330 is rotatably mounted in a respective carrier 340 which is displaceable longitudinally by a respective pneumatic cylinder-and-piston unit 341. A rack 342 (FIG. 17) extends from each roller carrier 340 at the opposite end from where it supports the roller 330. This rack has downwardly facing teeth which mesh with a small rotatable first pinion gear 343. A fixed rack 344 has upwardly facing teeth which engage the pinion 343 from below. A similar second pinion 345 is engaged between the respective racks 342 and 344 a short distance forward (i.e., into the machine) from the first pinion 343. The upper and lower racks 342 and 344 at each end of roller 330 extend parallel to each other. As best seen in FIG. 18, both pinions 343 and 345 of each pair are rotatably supported by a plate 346 which is connected by a cross pin assembly 346' to the outer end of the piston of the respective cylinder-and-piston unit 341.

Figure 23:
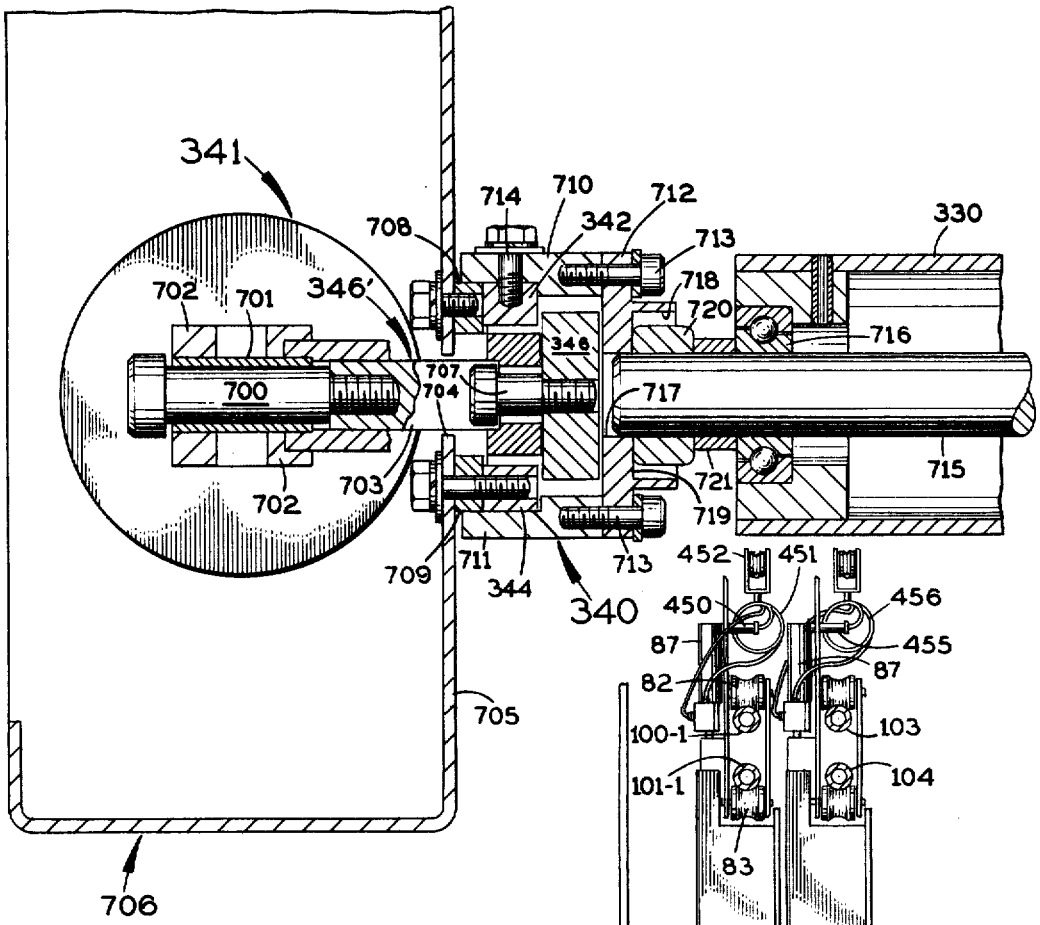
FIG. 23 is a cross-sectional view taken along line 23—23 of FIG. 18.

Referring to FIG. 23, the cross pin assembly 346' includes a bolt 700 received in a sleeve bearing or bushing 701 carried by a yoke 702 on the outer end of the piston rod 341*a* (FIG. 14) of the cylinder-and-piston unit 341. The screw-threaded inner end of bolt 700 is attached to a cylindrical rod 703, which is movable along an inclined slot 704 in the inside wall 705 of a housing 706 for the cylinder-and-piston unit 341. This housing 706 is fixedly mounted on the corresponding end cabinet 30 or 31. The inner end of the slide rod 703 is rigidly connected to the aforementioned plate 346.

As shown in FIG. 18, the plate 346 is located at the inner side of the lower rack 344 and the upper rack 342. Plate 346 rotatably supports the pinions 343 and 345 near its opposite ends. FIG. 23 shows the pivotal support for the pinion 343 in the form of a bolt 707 having a screw-threaded stem threadedly received in the plate 346 and a smooth cylindrical shank segment outside the plate on which the pinion 343 is rotatable. Bolt 707 has an enlarged head on its outer end which is received in a complementary counterbore 343*a* formed in the outer end face of pinion 343.

The other pinion 345 has an identical pivotal support on plate 346.

With this arrangement, the plate 346, the pinions 343 and 345, and the cross pin assembly 346' move in unison with the piston rod 341*a* of the cylinder-and-piston unit 341.

A pair of upper and lower guide rails 708 and 709 (FIG. 23) are bolted to the inside wall 705 of housing 706. The lower rack 344 is affixed to the inside of the lower guide rail 709 by the same bolts which mount this guide rail on the housing wall 705. The guide rails 708 and 709 are located above and below the slot 704 in the housing wall 705 and they extend at the same inclination downward toward the entry side of the machine.

With this arrangement, the lower rack 344 is fixedly mounted on the housing 706, and it is inclined downward toward the entry side of the machine.

The roller carrier 340 comprises top and bottom plates 710 and 711 to which an inner plate 712 is attached by bolts 713 to provide a unitary channel. The upper rack 342 is attached by bolts 714 to the bottom of the top plate 710. The top plate 710 has a flat bottom face which slidably engages the flat top face of the upper guide rail 708. The flat bottom face of the lower rack 344 and the flat bottom face of the lower guide rail 709 are slidably engaged by the top face of the bottom plate 711 of the roller carrier 340.

With this arrangement, the roller carrier 340 and the upper rack 342 are slidable as a unit along the fixed guide rails 708 and 709.

The lower front roller 330 of the conveyor is rotatably mounted on a horizontal shaft 715 by a ball bearing 716 at each end. The shaft 715 extends beyond the roller into a central opening 717 in the end wall 712 of the roller carrier 340. This end wall presents a cylindrical projection 718 at its inner end which extends concentrically around the opening 717. Inside this projection the end wall 712 presents a flat end face 719. A pair of cylindrical spacers 720 and 721 are engaged between this end face and the outside of the ball bearing 716 for roller 330.

With this arrangement, the sliding movement of the roller carrier 340 along the fixed guide rails 708 and 709 is imparted to the roller 330 without impairing the freedom of the roller to rotate freely. Roller 330 is moved at a differential rate of 2:1 as compared to the movement of the piston.

Figure 14:
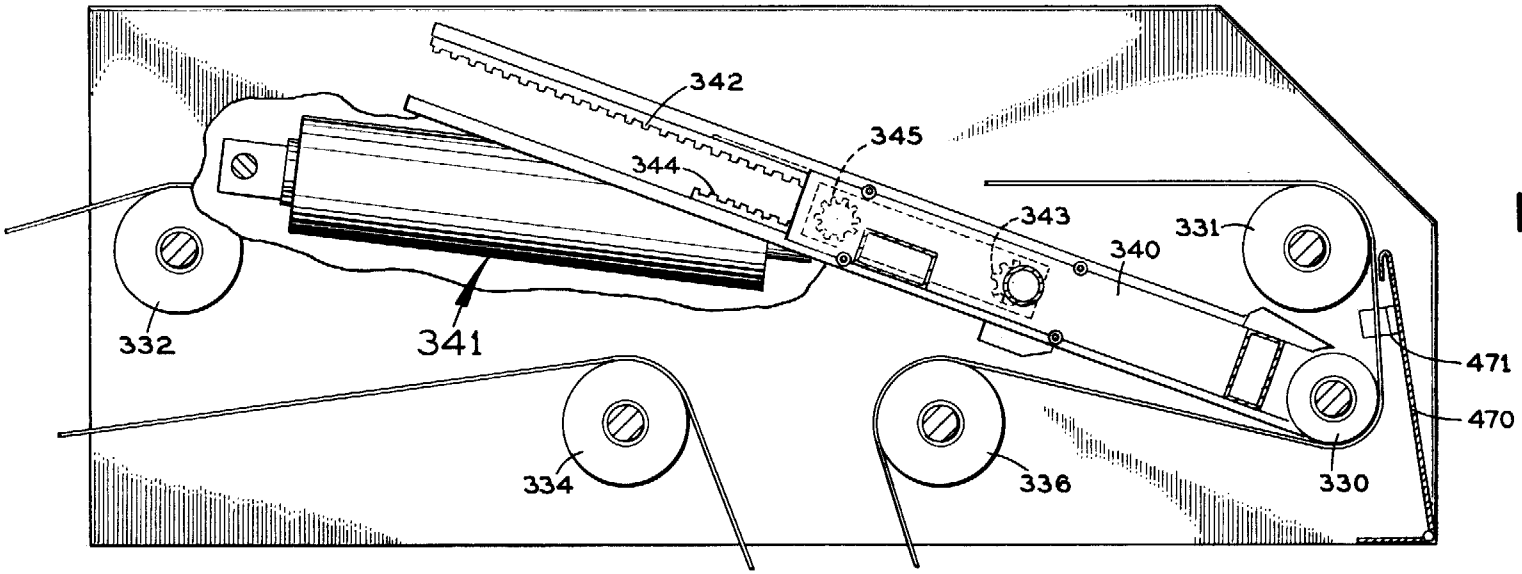
FIG. 14 is a fragmentary view of a conveyor arrangement showing the conveyor in a retracted position.
Figure 19:
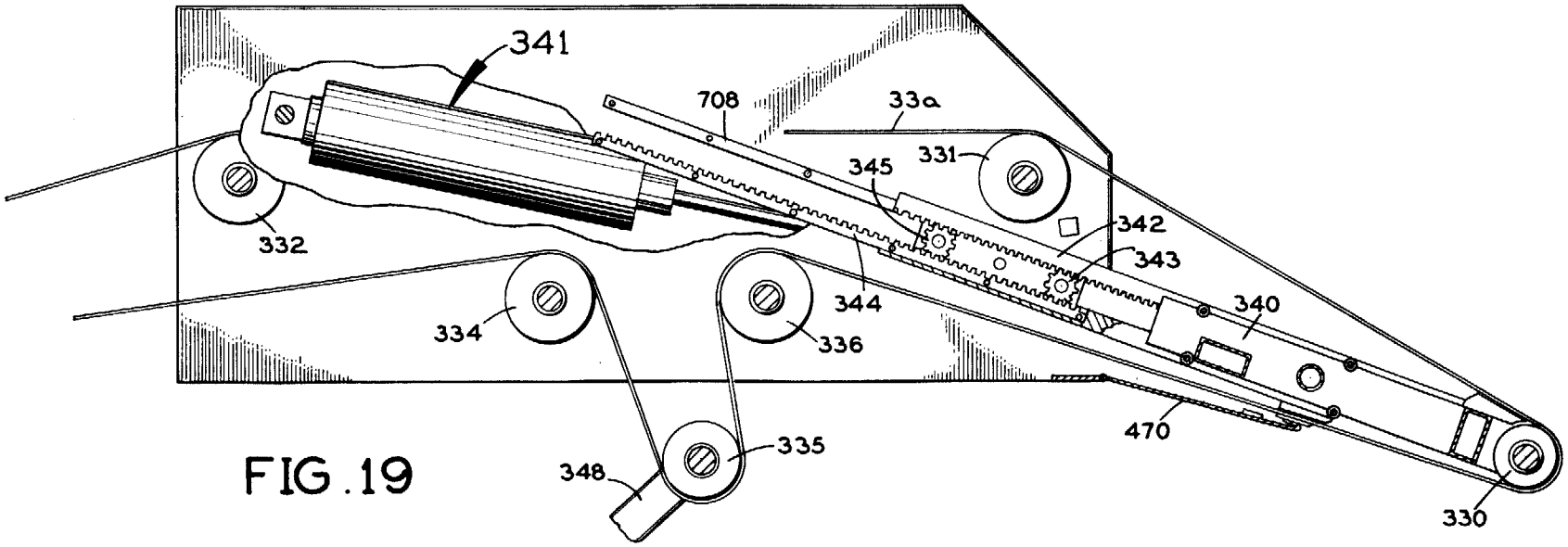
FIG. 19 is a view similar to FIG. 14 showing the conveyor in an extended position.

As shown in FIG. 14, when the pistons of the respective cylinder-and-piston units 341 are retracted, the lower rear roller 330 is in its normal retracted position. As shown in FIG. 19, when the pistons are extended, roller 330 is in its extended position, displaced downward toward the entry side of the machine from its normal retracted position.

The lower roller 335 for the conveyor belt 33*a* is rotatably mounted on the front ends of respective arms 348 (FIGS. 2 and 3). The back ends of these arms are horizontally pivoted at 349. A pair of tension springs 350 and 351 act on these arms to pull them down to the horizontal position shown in FIGS. 2 and 3. However, when the lower front roller 330 is moved out to its extended position by the cylinder-and-piston units 341 (FIG. 17), the conveyor belts 33*a* pull the lower roller 335 up. The downward pull of springs 350 and 351 maintains the conveyor belts 33*a* under the desired degree of tension in both positions of rollers 330 and 335.

At the entry side of the machine a pivoted cover plate 470 (FIG. 14) normally is held up in front of rollers 330 and 331 by a magnetic catch 471. This plate 470 is manually moved down out of the way (FIG. 19) when the roller 330 is moved to its extended position.

The conveyor also has sets of upper, flexible, endless conveyor belts 352 (FIG. 2) which overlie the lower conveyor belts 33*a* where the latter pass over the roller 332. The upper conveyor belts 352 extend around a front idler roller 353 and a back idler roller 354, which are respectively located in front of and behind the roller 332.

The vertical position of roller 332 is such that it flexes the lower run of the upper conveyor belts 352 upward slightly to maintain an appropriate tension on these belts. The purpose of the upper conveyor belts 352 is to hold the laundry flatwork down on the lower conveyor belts 33*a* near roller 332, and to exert a stretching action on the flatwork.

The back roller 335 for the lower conveyor belts 33*a* and the back roller 354 for the upper conveyor belts 352 are rotatably supported at their opposite ends by respective plates 355 (FIGS. 2,3,17 and 18). These plates 355 are pivotally connected to the upper ends of respective posts 356 which, as shown in FIG. 2, are inclined downward from these plates toward the entry side of the machine. The lower ends of the posts 356 are pivotally supported from the framework of the machine. The length of the posts 356 is telescopically adjustable to provide the desired belt tension in the conveyor.

SPREADERS

At the entry side of the machine (FIG. 1) two pairs of confronting, laterally directed, flexible endless belts 41–42 and 43–44 are located a short distance below the conveyor belts 33*a*. The paired belts 41–42 are at the left side of the longitudinal centerline of the conveyor 33, and the paired belts 43–44 are at the right side of this centerline. The left-hand belts 41–42 present contiguous runs which move from the center laterally outward to the left for spreading from the center to the left the part of a sheet which passes up between them. The right-hand belts 43–44 present contiguous runs which move from the center laterally outward to the right for spreading from the center to the right another part of the same sheet passing up between them. Therefore, the paired belts 41–42 and 43–44 will be referred to as spreader belts.

The respective rear spreader belts 42 and 44 are longer than the respective spreader belts 41 and 43 with which they are paired, and they extend laterally inward past the latter toward the the longitudinal centerline of the apparatus. This provides a gap between the front belts 41 and 43 midway across the apparatus at its entry side where a sheet may hang down directly behind the rear belts 42 and 44. This facilitates the passage of the sheet up between the confronting pairs of spreader belts 41–42 and 43–44, with the belts 41–42 spreading part of the sheet to the left as it passes up between them and with the belts 43–44 spreading another part of the sheet to the right as it passes up between them.

At the right side of the machine in FIG. 1, the rear belt 44 is driven by a vertical drive roller 45 (FIG. 2) at its laterally outboard (right) end. This drive roller is on the upper end of a rotatable vertical shaft 46 which extends up from a pulley 47 driven by a belt 48 from an idler pulley 49. The idler pulley is driven from an electric motor 50 by a belt 51.

The shorter front belt 43 at this side of the machine is driven by a vertical drive roller 52 (FIG. 2) at its laterally outboard (right) end. This drive roller is on the upper end of a vertical shaft 53 which carries a gear 54 driven by a gear 55 on shaft 46. Shaft 53 is rotatably mounted on the framework of the machine.

With this arrangement, the respective drive rollers 45 and 52 for belts 44 and 43 are rotated in opposite directions by the motor 50 and they pull the confronting, contiguous runs of these belts laterally outboard (i.e., from left to right in FIG. 1).

The other pair of spreader belts 41, 42 are driven in the same manner, with the confronting, contiguous runs of these belts being pulled from right to left laterally outward in FIG. 1. The drive arrangement for belts 41, 42 is a mirror image of the one for belts 43,44 and therefore need not be described in detail. In FIG. 4, the drive roller and other parts associated with belt 42 are given the same reference numerals as those associated with belt 44, but with a "prime" suffix added.

As shown in FIG. 4, the laterally inward end of spreader belt 44 extends around a rotatably mounted idler roller 56. Likewise, the laterally inward end of spreader belt 42 extends around a rotatably mounted idler roller 56'. Both of these idler rollers are supported from the framework of the machine.

Figure 9:
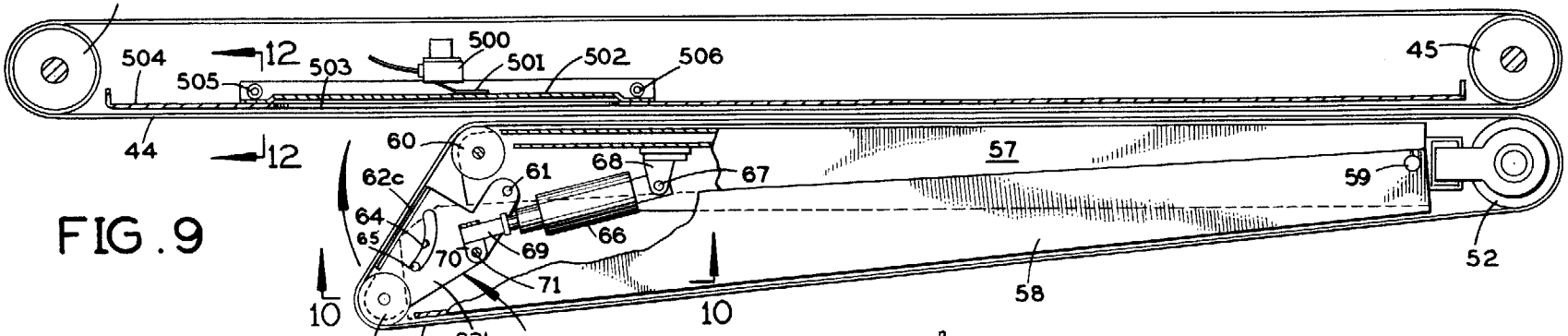
FIG. 9 is a sectional view taken along line 9—9 of FIG. 1.

A pivotally articulated three-piece linkage is located inside the endless loop formed by spreader belt 43. Referring to FIG. 9, this linkage comprises a fixedly mounted member 57, which is located toward belt 44, a pivotally adjustable member 58, which is located away from belt 44, and a linkage piece 62 acting between members 57 and 58. The linkage members 57 and 58 are pivotally connected at 59 a short distance laterally inward from the drive roller 52 for belt 43. Each of the linkage members 57 and 58 is generally channel-shaped in cross-section and the pivotally adjustable member 58 fits snugly but slidably outside the fixed member 57.

At its laterally inward end the fixed linkage member 57 carries an idler roller 60 (FIG. 9), which is located in close proximity to belt 44. Belt 43 extends around this idler roller 60 at the beginning of its laterally outward run of course of movement in contiguous, confronting relationship to belt 44.

The third linkage piece 62 has upper and lower walls 62*a* and 62*b* (FIG. 10) which respectively fit closely below and above the upper and lower walls of the fixed linkage member 57. At one end of the third linkage piece 62, aligned vertical pivot pins 61 (FIG. 10) connect its upper and lower walls to the corresponding walls of linkage member 57. At its opposite end, the linkage piece 62 carries a roller 63 around which the spreader belt 43 extends. The linkage member 62 has a bridge segment 62*c* (FIG. 9) which extends between and interconnects its upper and lower walls. This bridge segment is located just inside the spreader belt 43 where the latter passes from roller 63 to roller 60.

Aligned arcuate slots 64 are formed in the upper and lower walls 62*a* and 62*b* of linkage piece 62, as best seen in FIG. 9. A cross pin 65 carried by the pivotally adjustable linkage member 58 is snugly but slidably received in these slots 64 to couple the third linkage piece 62 to the pivoted linkage member 58.

Figure 11:
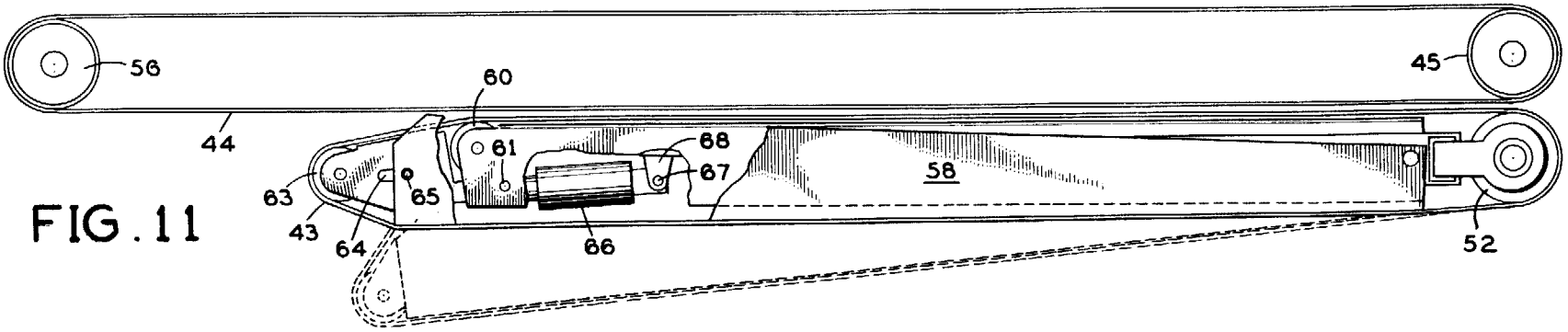
FIG. 11 is a view similar to FIG. 9 showing a portion of the spreader belts in a changed position.

A pneumatic cylinder-and-piston unit 66 acts between the fixed linkage member 57 and the third linkage piece 62 for moving the spreader belt between its normal position, shown in full lines in FIG. 9 and in phantom in FIG. 11, to a retracted position, shown in full lines in FIG. 11. The cylinder of this unit is pivotally mounted at 67 on a bracket 68 attached to the inside of linkage member 57. The piston of this unit has a square extension 69 on its outer end which is rigidly fastened to a channel-shaped yoke 70. This yoke carries a cross pin 71 whose opposite ends are received in complementary openings in the upper wall 62*a* and the lower wall 62*b* of the third linkage piece.

Figure 10:
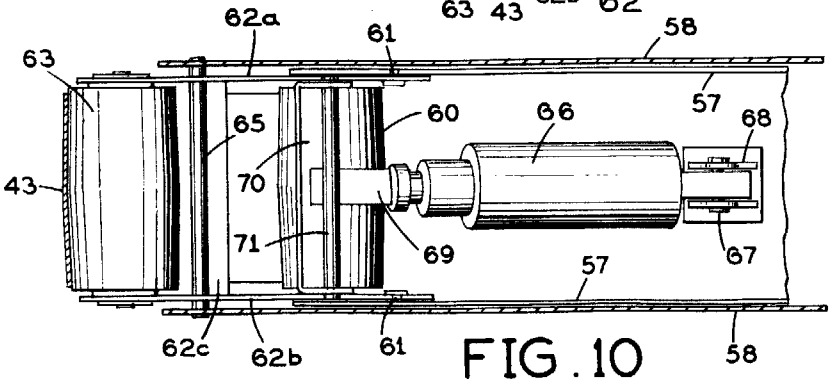
FIG. 10 is a sectional view taken along line 10—10 of FIG. 9.

With this arrangement, when the cylinder-and-piston unit 66 is actuated to extend the piston from the normal, retracted position shown in FIGS. 9 and 10, the outward movement of the piston is imparted through the yoke 70 and cross pin 71 to the third linkage piece 62, causing the latter to pivot about pins 61 clockwise in FIG. 9 (with respect to the fixed linkage member 57). Such pivotal movement of linkage piece 62 is imparted through the slot-and-pin coupling 64–65 to the pivoted linkage member 58, causing the latter to pivot about pin 59 clockwise with respect to linkage member 57 from the phantom-line position in FIG. 11 to the full line position in that Figure.

An identical arrangement is provided at the other front spreader belt 41 for retracting it at the same time that spreader belt 43 is retracted.

The purpose of retracting the spreader belts 41 and 43 to the full line position of FIG. 11 is to get them out of the way of the machine operators when small laundry pieces are being fed into the machine. Such small pieces do not require the lateral spreading action of the spreader belts at the entry side of the machine. The motor drive to these spreader belts is disabled at this time, as described in detail hereinafter. Also, when the spreader belts are retracted and disabled, the conveyor 33 will be in its extended position at the entry side of the machine, as shown in FIGS. 17 and 19.

Figure 13:
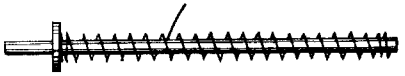
FIG. 13 is a detailed view of a pin included in FIG. 12.
Figure 12:
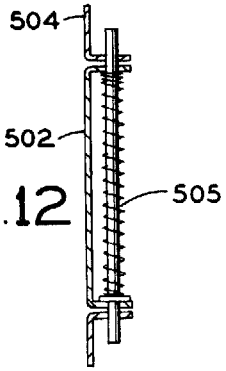
FIG. 12 is a sectional view taken along line 12—12 of FIG. 9.

At each pair of the spreader belts 41–42 and 43–44 a safety switch is provided to stop the belts if one of the machine operators gets her hand caught between the belts. FIGS. 9, 12 and 13 show the safety switch arrangement for belts 43–44. The safety switch arrangement for belts 41–42 is the same.

Referring to FIG. 9, a snap-acting switch 500 is mounted inside the rear spreader belt 44. The actuator 501 of this switch engages the back of a flat plate 502, which extends across an opening 503 formed in an elongated plate 504 extending directly behind the run of belt 44 which is next to the front spreader belt 43 of this pair. The laterally inward edge of the opening 503 is located inward past the front spreader belt 43 in the latter's normal operating position, as shown in FIG. 9. The laterally outward edge of the opening 503 is located outward past the roller 60 where the spreader belts 43 and 44 first come into confronting, contiguous relationship to one another. A pair of spring biased pins 505 and 506 extend behind plate 502 at its opposite ends. These pins normally hold plate 502 against the back of the longer plate 504.

If the operator's hand or some other foreign object gets caught between the confronting runs of the spreader belts 43, 44 or is closely approaching entry between these belts, the foreign object will bend the plate 502 in and operate the safety switch 500, which will turn off the motor driving the rear belt 44.

Each spreader belt 41,42, 43 and 44 presents a plurality of closely spaced, outwardly protruding bristles across its entire extent for more effectively gripping the laundry flatwork.

BLOWDOWN

Three blowpipes B-1, B-2 and B-3 (FIG. 1) extend horizontally above the level of the conveyor belts 33*a* at the entry side of the machine. The left and right blowpipes B-1 and B-2 extend transversely across the conveyor for most of its width respectively to the left and right of the longitudinal centerline of the machine. The middle blowpipe B-3 extends transversely across a narrow region at the center of the conveyor 33. Referring to FIG. 16, the left blowpipe B-1 comprises an elongated horizontal tube 360 having an air inlet connection 361 midway along its length and having its opposite ends closed. The tube 360 on one side carries a plurality of discharge nozzles 362 at evenly spaced intervals along its length. Each nozzle has a horizontally elongated, vertically narrow discharge opening 363 (FIG. 24), so that air is discharged from the nozzle in a fan-like pattern which has a narrow dimension vertically and a much wider, diverging flow transverse to the conveyor 33. The fan-like discharged from adjacent nozzles 362 merge into each other to provide a continuous forwardly moving blanket of air across the entire transverse extent of the conveyor 33 served by that blowpipe.

The right blowpipe B-2 is of the same construction as the blowpipe B-1.

If desired, the nozzles 362 may be set into the corresponding blowpipe tube 360 at acute angles so that the central axis of each nozzle's spray pattern extends forward and laterally outward at an acute angle.

The middle blowpipe B-3 has a short horizontal tube carrying a small number of spray nozzles which are set to spray forward and laterally outward on each side, so that the combined action of the three blowpipes B-1, B-2 and B-3 is an uninterrupted blanket of forwardly moving air which completely covers the conveyor 33 from side to side.

This blanket of air moves at a slight angle upward with respect to the path of the conveyor belts 33*a* from the upper front roller 331 to the intermediate roller 332 (FIG. 2). This forwardly moving blanket of air holds the laundry flatwork piece down on the conveyor belts 33*a* until it passes beneath the upper conveyor belts 352, from which point the upper conveyor belts 352 hold it down on the lower conveyor belts until it approaches the point (at the rear roller 333) where it moves off the lower conveyor belts 33*a*.

A pair of vertical straps 364 suspend the left blowpipe B-1 in the horizontal position shown in FIG. 2. This is also true of the right blowpipe B-2. The short middle blowpipe B-3 is suspended by a vertical strap 365. The upper ends of these straps are attached to the top carriage 32 of the machine. Thus, the blowpipes move in unison with the top carriage 32 when it is displaced, as described hereinafter.

Flexible hoses 366 connect the blowpipes B-1, B-2 and B-3 to a suitable source of pressurized air through normally-closed solenoid valves.

TOP CARRIAGE

The top carriage 32 is mounted on two rollers 392 (FIGS. 4 and 8) at each side of the machine. These rollers roll along fixed horizontal tracks 393 at the top of the respective end cabinets 30 and 31 of the machine. At each side a pneumatic cylinder-and-piston unit 394 (FIG. 8) moves the top carriage between a normal position (shown in full lines in FIG. 8) and a retracted position (shown in phantom in FIG. 8). In its normal position, the top carriage closes a limit switch 389, for a purpose explained hereinafter. In its retracted position, the top carriage closes a limit switch 389'.

Figure 8:
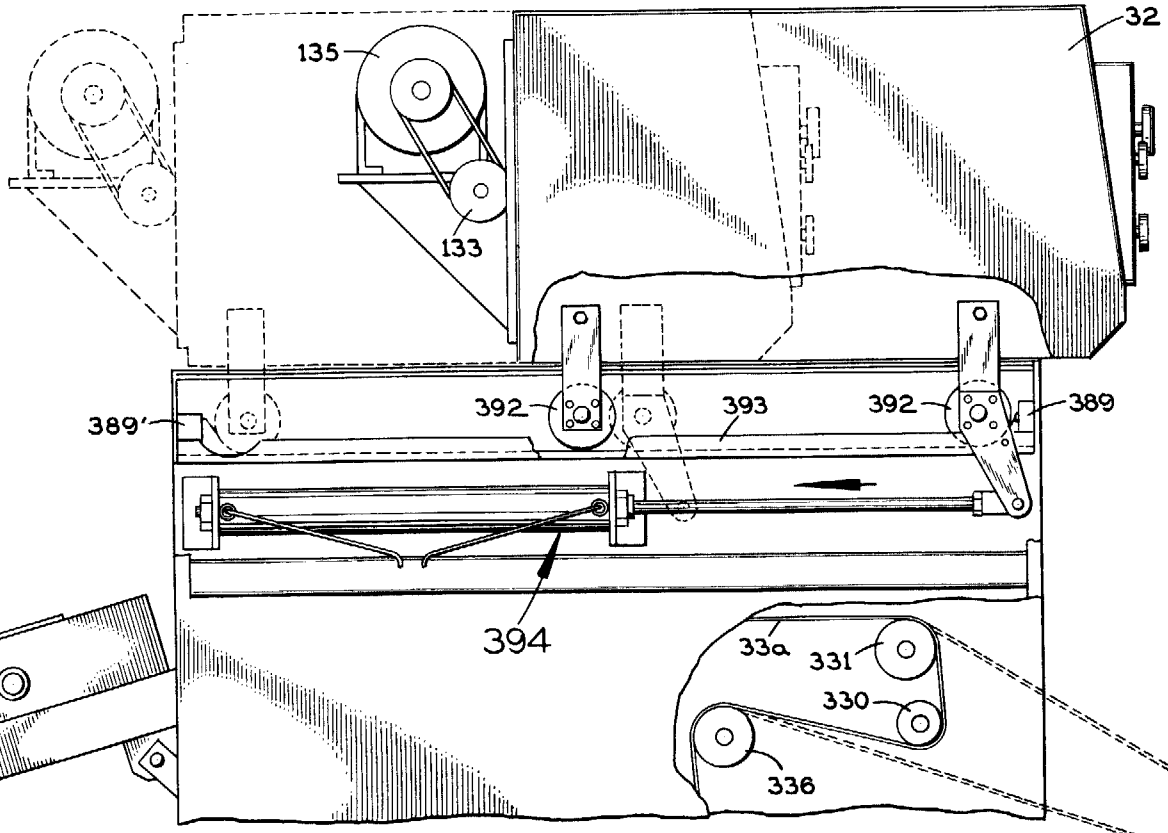
FIG. 8 is a sectional view taken along line 8—8 of FIG. 4.

The pair of pneumatic cylinder-and-piston units 394 for positioning the top carriage 32, the pair of pneumatic cylinder-and-piston units 341 for positioning the lower front roller 330 of conveyor 33, and the pair of pneumatic cylinder-and-piston units 66 for positioning the spreader belts 41 and 43 are operated in synchronism such that:

(a) when large laundry workpieces are to be fed into the machine, the spreader belts 41 and 43 are in their operative positions (as shown in FIG. 9), the conveyor 33 is in its retracted position (as shown in full lines in FIG. 8), and the top carriage 32 is positioned toward the entry side of the machine (as shown in full lines in FIG. 8); and (b) when short laundry workpieces are to be fed into the machine, the spreader belts 41 and 43 are retracted to their inoperative positions (as shown in full lines in FIG. 11), the conveyor 33 is in its extended position (as shown in phantom in FIG. 8), and the top carriage 32 is retracted (as shown in phantom in FIG. 8).

SHEET SPREADING AND DEPOSITING ON CONVEYOR

The top carriage 32 carries three pairs of sheet clamps, each pair served by an individual machine operator whose job is to insert the adjacent corners on the upper end of a sheet or other large laundry workpiece into his or her pair of clamps, after which these clamps are spread apart laterally from the middle of the apparatus to the left and right, respectively. The three pairs of clamps are operated one at a time and they act on different sheets. Normally, the three pairs of clamps are positioned at the middle, left end and right end of the apparatus. The middle clamps are designated M-1 and M-2 in FIG. 1, the left end clamps are designated L-1 and L-2, and the right end clamps are designated R-1 and R-2. The clamps do not operate when short workpieces are being fed into the machine.

Assuming that the operator at the middle of the machine is ready first, followed by the operator at the left, and later by the operator at the right, the sheet spreading and depositing operations take place as follows:

(1) After the corners of one sheet are inserted in the clamps M-1 and M-2 of the middle pair, clamp M-1 is moved horizontally to the left and clamp M-2 is moved horizontally to the right, carrying the respective adjacent corners of this sheet away from each other to spread the top edge of the sheet. The trailing part of the sheet hanging down from these clamps is engaged between the spreader belts 41 and 42 (to the left) and between the spreader belts 43 and 44 (to the right), and the direction of movement of these spreader belts is such that this trailing part of the sheet is spread to the left and to the right on opposite sides of its centerline between its clamped upper corners.

The clamps M-1 and M-2 release the respective corners of this sheet after these clamps stop at their outermost positions to the left and right, respectively. The blowpipes B-1, B-2 and B-3 then discharge air to force the just-released, spread-open leading end of the sheet down onto the forwardly-advancing upper run of conveyor 33. The timing of the release of the sheet by the clamps and the discharge of air by the blowpipes is under the control of a photoelectric sensor 78 (FIG. 2) at the longitudinal center of the machine. As both clamps move laterally outward, the top edge of the sheet moves past sensor 78, which senses the rising middle part of the sheet's top edge. Adjustment of the heighth of 78 and its reflector controls the tension of the sheet. An adjustable time delay is provided between this sensing and the stopping of the laterally outward movement of the clamps. This allows for adjusting the tension on the sheet. The clamps open to release the sheet after they reach their outermost positions, provided the spacing between successive sheets is sufficient. After another adjustable time delay following the opening of the clamps, the blowpipes B-1, B-2 and B-3 are supplied with pressurized air for an adjustable time interval to blow the just-released sheet onto the conveyor 33.

This conveyor 33 pulls the trailing part of the sheet up between the paired spreader belts 41–42 and 43–44, and these paired belts continue to spread the sheet laterally outward in each direction as it is drawn up between them.

Figure 7:
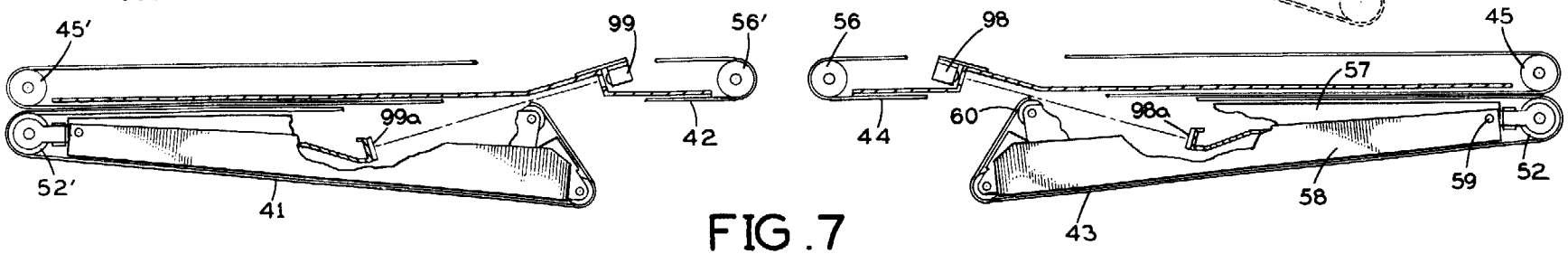
FIG. 7 is a sectional view taken along line 7—7 of FIG. 1.

Two trailing edge sensors 98 and 99 (FIG. 1) are located respectively below the left-hand spreader belts 41, 42 and the right-hand spreader belts 43, 44. Each of these sensors comprises a photoelectric cell which senses light reflected from an adjacent reflector 98a and 99a. The position of these elements laterally of the machine is shown in FIG. 7, from which it will be apparent that a sheet being spread apart by the paired spreader belts 41, 42 and 43, 44 will hang down over the photocells 98 and 99 until the trailing edge of this sheet moves up past them.

The photocells 98 and 99 are at different levels, with photocell 98 being lower. Both are adjustable vertically but photocell 99 will always be higher. Since they are at different levels, the trailing edge of a sheet will move up past photocell 98 before it moves up past photocell 99.

When the conveyor 33 in the machine is operated at slow speed, both photocells 98 and 99 will be connected in the control circuit of the machine in such a way that the circuit will respond to the energization of the last one (the higher photocell 99) to be uncovered by the upward movement of the trailing edge of the sheet past it. When the conveyor 33 is operated at high speed, the upper photocell 99 is disabled and the control circuit will respond only to the energization of the lower photocell 98 when the trailing edge of the sheet moves past it. This is described in more detail in the following description of the FIG. 20 control circuit.

(2) The corners of another sheet are inserted in the clamps L-1 and L-2 at the left end of the machine by an operator there who then pushes a start or grading button. This may be done any time the clamps are at this feed station. When the middle clamps M-1 and M-2 start returning to the middle station, the left clamps L-1 and L-2 are actuated to move in unison to the right, carrying their sheet across the spreader belt 41 on that side until they reach the centered position where they stop. Upon the movement of the trailing edge of the preceding sheet up past the sensor 98 or 99 which is then effective, or the end of a minimum pause interval, whichever occurs later, the clamp L-1 now is moved horizontally to the left and clamp L-2 is moved horizontally to the right.

The same operation now takes place on this sheet as has been described in detail for the preceding sheet acted on by the middle clamps M-1 and M-2.

(3) The corners of a third sheet S-R are inserted in the clamps R-1 and R-2 at the right end of the apparatus by the operator there. When the left clamp L-2 starts returning to the left station, the right clamps R-1 and R-2 are moved in unison to the left to the centered position, carrying their sheet across the spreader belt 43 on that side. After pausing at the middle for a minimum pause interval or after a time delay following the uncovering of the effective trailing edge sensor 98 or 99 by the trailing edge of the immediately preceding sheet, whichever is longer, clamp R-1 is moved to the left and clamp R-2 is moved to the right. These clamps spread apart the top corners of this sheet and pass the trailing part of the sheet between the paired spreader belts 41–42 and 43–44.

The same operation now takes place on this sheet as has been described in detail for the sheet acted on by the middle clamps M-1 and M-2.

It is to be understood that the apparatus follows a "demand" sequence of operation. That is, the order in which the respective sets of clamps are operated depends upon the order in which the machine operators signal their readiness after inserting their respective sheets in the corresponding paired clamps.

Figure 15:
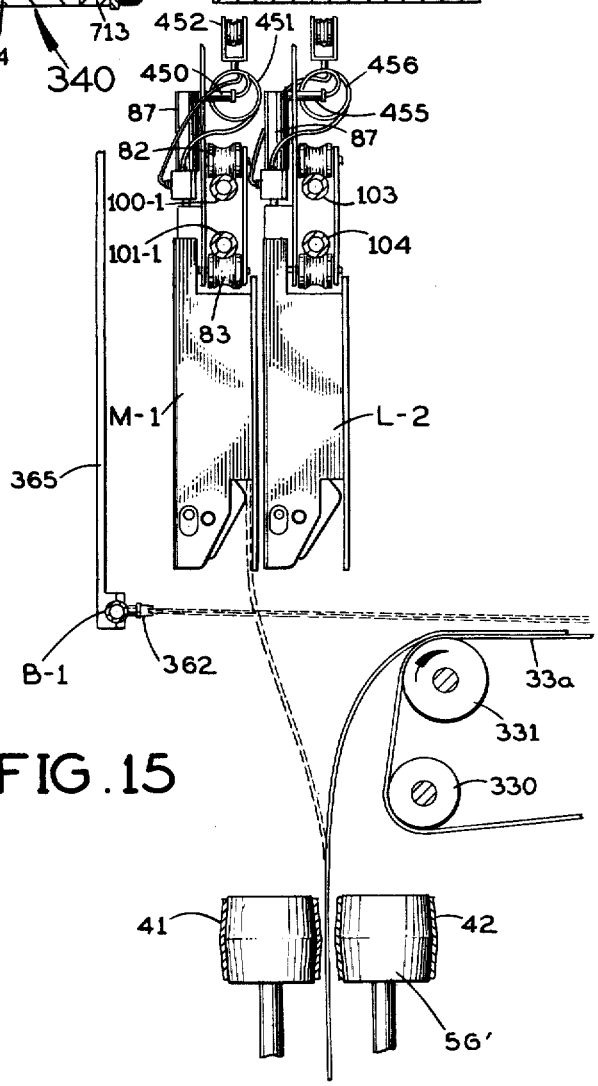
FIG. 15 is a fragmentary view showing a laundry flatwork piece being blown down onto the conveyor.

Each sheet clamp of each pair preferably is constructed as disclosed in detail in U.S. Pat. No. 4,106,277. Each clamp is operated by a respective air cylinder 87 (FIG. 15) mounted in the top carriage 32. The clamp is closed when air pressure is applied to the top of the air cylinder and is released from the bottom; it is opened when pressure is supplied to the bottom of the cylinder and released from the top (not explained in previous patent). Therefore, it will be apparent that a sheet whose top edge is held by any pair of clamps L-1 and L-2, M-1 and M-2, or R-1 and R-2 is released by those clamps when pressurized air is supplied to the lower part of the respective air cylinders 87 for those clamps.

FIG. 4 shows the middle clamp M-1 as being slightly mounted on a pair of upper and lower, cantilevered, horizontal guide rods 100-1 and 101-1, which are mounted at the left side of the top carriage 32 and terminate just short of the centerline of the machine. These guide rods are rigidly interconnected by a vertical connecting piece extending between them. The middle clamp M-1 has an upper roller 82 (FIG. 15), which is in rolling engagement with the top of the upper guide rod 100-1, and a lower roller 83 in rolling engagement with the bottom of the lower guide rod 101-1.

The other middle clamp M-2 is slidably mounted on similar upper and lower cantilevered horizontal guide rods 100-2 and 101-1, which are mounted at the right side of the top carriage 32 and terminate just short of the machine's centerline. As shown in FIG. 2, clamp M-2 has an upper roller 82-2 in rolling engagement with the top of the upper guide rod 100-2 and a lower roller 83-2 in rolling engagement with the bottom of the lower guide rod 101-2.

The mounting of the rods 100-1, 101-1 for clamp M-1 and the mountings of the rods 100-2, 101-2 for clamp M-2 have enough play in them to permit the free ends of these rods to be displaced as much as 3 inches toward the entry side of the machine and away from the conveyor 33, midway across the machine at its entry side. An air cylinder-and-piston unit is coupled to the adjacent free inner ends of these paired rods for effecting such displacement.

The clamps L-1 and L-2 which normally are at the left end of the apparatus are similarly mounted on a single pair of horizontal guide rods 103 and 104 (FIG. 15) which extend completely across the entry side and are spaced forward (i.e., in the direction into the apparatus away from its entry side) from the respective paired guide rods for the middle clamps M-1 and M-2. These guide rods 103 and 104 are interconnected by a rigid vertical piece 105.

The right end clamps R-1 and R-2 are slidable on the same horizontal guide rods 103 and 104 as clamps L-1 and L-2.

The two middle clamps M-1 and M-2 are coupled separately to respective flexible endless cables to be displaced from their normal position close together midway across the apparatus at its entry side to their extended positions at the left and right ends respectively, of the apparatus.

As shown in FIG. 2, clamp M-2 is carried by an attachment piece 106 having a vertical leg which is fastened to this clamp next to its air cylinder 87. This attachment piece extends up from the clamp and has its upper end attached to a horizontal cable 111. As shown schematically in FIG. 4, the cable 111 is an endless flexible cable which extends from a pulley 112 at the left end of the apparatus to a pulley 113 at its right end. The connection 110 between the attachment piece 106 for the clamp M-2 and the cable 111 is made on the lower horizontal run of this cable.

Figure 5:
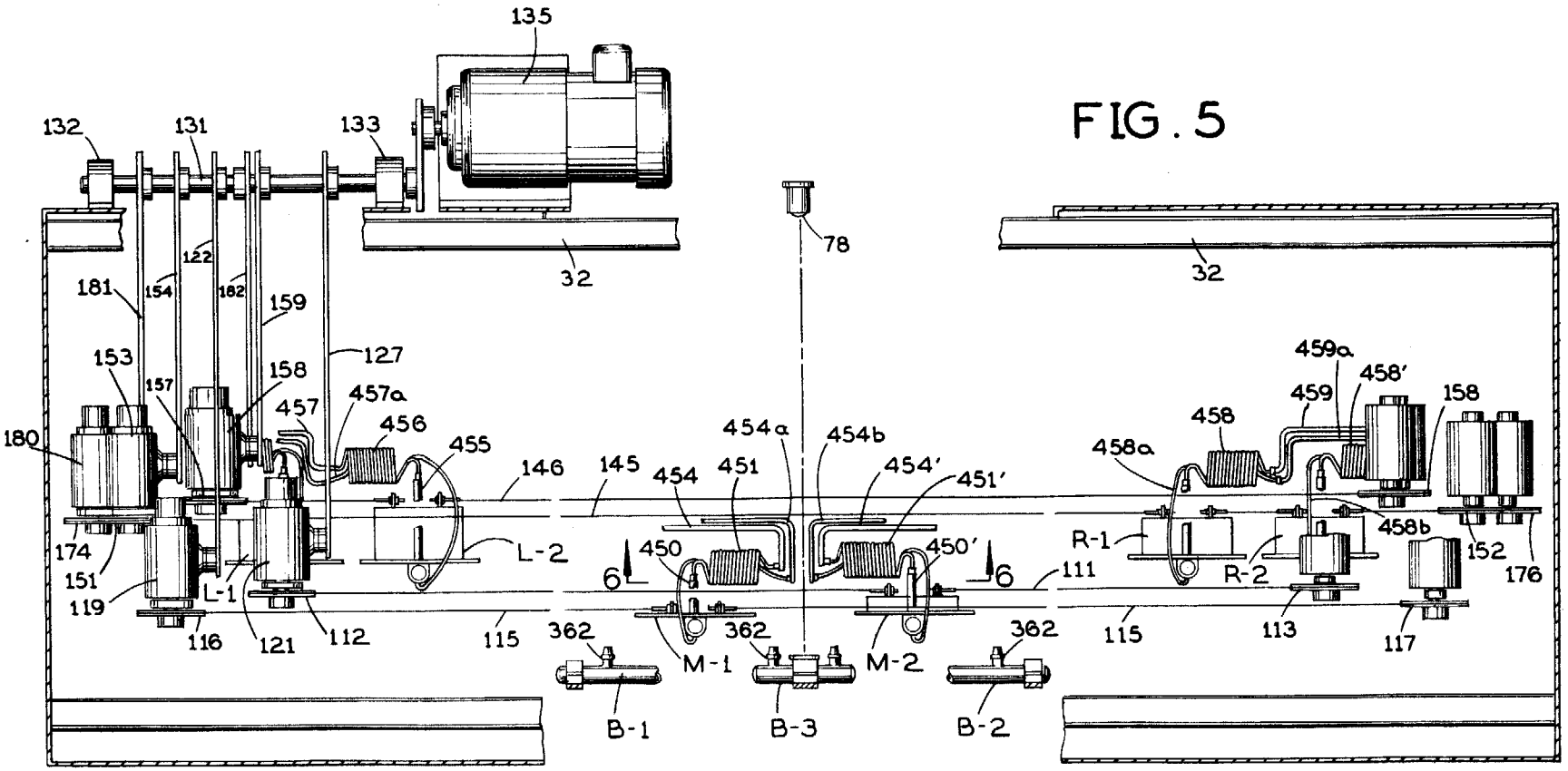
FIG. 5 is a sectional view taken along lines 5—5 of FIG. 4.

The other middle clamp M-1 has a similar connection to a similar cable 115, which extends around a pulley 116 at the left side of the machine and around a pulley 117 at the right. As shown in FIG. 5, the pulleys 116, 117 and cable 115 are offset in front of the pulleys 112, 113 and cable 111 to avoid interference between them.

As shown in FIG. 5, the left end pulley 116 for cable 115 is mounted on the output shaft of a reversible clutch-brake unit 119 of known design, having a brake which is electrically-applied and spring-released and a clutch which is electrically-engaged and spring-released for driving an output shaft in one direction or the other. The clutch-brake unit has an input shaft carrying a pulley driven by a flexible endless chain 122, whose opposite end is driven by an idler pulley 123.

The idler pulley 123 is driven by a flexible endless belt 129 whose opposite end extends around a drive pulley mounted on a horizontal drive shaft 131 extending transversely across the interior of the top carriage 32 of the apparatus framework and rotatably supported by bearings 132 and 133 at opposite ends.

These bearings are supported by the top carriage 32 of apparatus framework. Drive shaft 131 is driven by an electric motor 135 through a belt and pulleys. As long as motor 135 is on, the drive shaft 131 is driven continuously. Normally the clutch-brake unit 119 for cable 111 is energized so that the brake is applied and the clutch is disengaged.

Referring to FIG. 5, the pulley 112 at the left end of the cable 111 for the clamp M-2 is driven through a similar clutch-brake unit 124 located directly to the right of the aforementioned clutch-brake unit 119. The clutch-brake unit 124 has an input shaft carrying a pulley which is driven through a flexible endless chain 127 from a pulley 128 on the shaft 131.

The outer left end clamp L-1 is coupled to a flexible endless cable 145 (FIG. 4) which is spaced below and behind the cables 111 and 115 for the middle clamps M-1 and M-2. Clamp L-1 is attached to the lower horizontal run of cable 145. Cable 145 extends around a pulley 151 at its left end and around an idler pulley 152 at its right end.

The inner left end clamp L-2 is coupled to a flexible endless cable 146 (FIG. 5), which is located behind and below cable 145. Clamp L-2 is attached to the upper horizontal run of cable 146. Cable 146 extends around a pulley 157 at its left end and around an idler pulley 158 at its right end.

The drive pulley 151 for cable 145 is driven through a clutch-brake unit 153 (of the type already described) from the drive shaft 131 through a chain 154.

Similarly, the drive pulley 157 for cable 146 is driven through a clutch-brake unit 158 from the drive shaft 131 through a chain 159.

The inner right end clamp R-1 is coupled to a flexible endless cable 166 (FIG. 4). Clamp R-1 is attached to the upper horizontal run of cable 166. Cable 166 extends around a drive pulley 174 at its left end and around an idler pulley 176 at its right end. Pulley 174 is driven through a clutch-brake unit 180 (FIG. 5) from the drive shaft 131 through a chain 181.

The outer right end clamp R-2 is coupled to a flexible endless cable 165 (FIG. 4). Clamp R-2 is attached to the lower horizontal run of cable 165. Cable 165 extends around a drive pulley 172 at its left end and around an idler pulley 171 at its right end. Pulley 172 is driven through a clutch-brake unit from the drive shaft 131 through a chain 182. This clutch-brake unit is below the clutch-brake unit 158 for pulley 157 and is hidden by it in FIG. 5.

In the operation of the apparatus, when the middle clamps M-1 and M-2 are at the middle of the machine and the operator there wants to insert the corners of a flatwork piece that is to be spread, the adjacent free ends of the rods 100-1, 101-1, 100-2 and 101-2 are displaced toward the operator about 3 inches by actuating the corresponding cylinder-and-piston unit. This moves the middle clamps away from any preceding flatwork piece already in the machine. This helps particularly when the flatwork pieces are wet and liable to tangle easily. After the flatwork piece is in the middle clamps M-1 and M-2, the free ends of their guide rods 100-1, 101-1, 100-2 and 101-2 are retracted (away from the operator and toward the conveyor 33) before they are spread apart. Now the middle clamps may be moved simultaneously from the centered position where they are close together midway across the apparatus, over to the spread apart positions in which clamp M-1 is at the left end and clamp M-2 is at the right end of the apparatus, and then they are moved simultaneously back to the centered position. To move these clamps apart, the cable 115 is driven clockwise in FIG. 4 through its clutch-brake unit 119 and the cable 111 is driven counterclockwise through its clutch-brake unit 124. To move these clamps together, the direction of movement of their respective cables is reversed.

In the sequence of operation of the left end clamps L-1 and L-2, these clamps are moved simultaneously from their normal position close together at the left end of the apparatus over to the middle of the apparatus (still close together). This is done by driving the cable 145 counterclockwise in FIG. 4 through its clutch-brake unit 153 and driving the lower cable 146 clockwise through its clutch-brake unit. Thereafter, these clamps are spread apart, by driving the upper cable 145 clockwise to move clamp L-1 back to its starting position at the left end of the apparatus and driving the lower cable 145 clockwise to move clamp L-2 to the right end of the apparatus. Finally, after these clamps have released their sheet, the upper cable 145 remains stationary while the lower cable 146 is driven counterclockwise to move clamp L-2 to the left end of the apparatus, close to clamp L-1.

In the operating sequence of the right end clamps R-1 and R-2, these clamps are moved simultaneously from their normal position close to each other at the right end of the apparatus over to the middle of the apparatus (still close to each other). This is done by driving the upper cable 165 clockwise in FIG. 4 through its clutch-brake unit and driving the lower cable 166 counterclockwise through its clutch-brake unit 180. Thereafter, these clamps are spread apart by driving cable 165 counterclockwise and cable 166 counterclockwise until the clamps are at a position where the sheet is spread. The clamps are stopped here. The clamps both return to the feed station after the sheet is released.

In accordance with one feature of the present invention, each air cylinder for each of the clamps M-1 and M-2, L-1 and L-2, and R-1 and R-2 receives air through a Siamese (or double) helically-wound extensible hose mounted on a corresponding trolley wire which extends horizontally from left to right across the inside of the top carriage.

Figure 6:
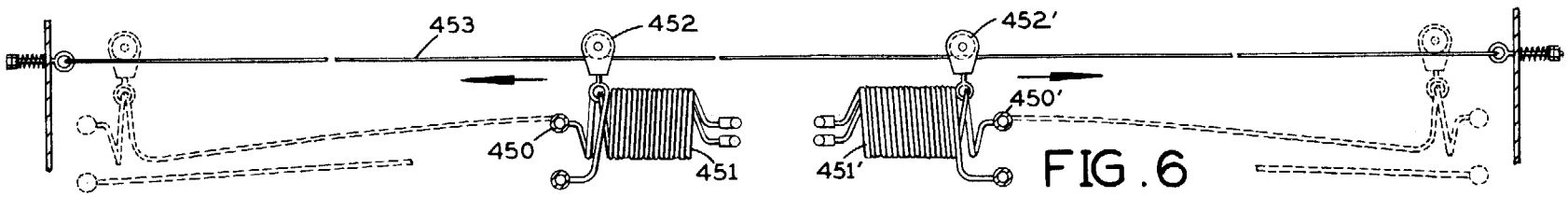
FIG. 6 is a fragmentary view taken along line 6—6 of FIG. 5.

Referring to FIGS. 5 and 6, the middle clamp M-1 has a horizontally extending fitting 450 on the back (FIG. 5) which is connected to the laterally outward end of a Siamese (or double) helically-wound flexible air hose 451 for supplying air to the air cylinder on this clamp. As shown in FIG. 6, this end of the helical hose is suspended by a roller 452 from a horizontal transverse wire 453 above. The laterally inward end of the helical air hose 451 is attached to the fixidly supported end of rigid air tubes 454, 454*a* FIG. 5 which extends horizontally laterally outward to a source of pressurized air mounted inside the top carriage 32 at its left end.

The other middle clamp M-2 has a similar air supply arrangement which is a mirror image of the one just described for clamp M-1. Corresponding elements of the air supply arrangement for clamp M-2 are given the same reference numerals as those for clamp M-1, but with a "prime" suffix added.

With this arrangement, when the middle clamps M-1 and M-2 are spread apart, the respective coiled air hoses unwind, and are extended in length, as shown in phantom in FIG. 6.

The left-hand clamp L-1 has a fitting 455 connected to the laterally inward end of a Siamese (or double) helically-wound, flexible, horizontally extending air hose 456. The laterally outward end of this hose is attached to a fixedly positioned, rigid air line 457 at the left side of the top carriage 32. A roller (not shown) at the laterally inward end of the helical hose 456 suspends it from a horizontal trolley wire (not shown) above.

The other left-hand clamp L-1 has a similar slidably supported Siamese (or double) helically-wound air hose connected to it in the same manner as for clamp L-2. This air supply arrangement for clamp L-1 is hidden below other parts of the apparatus in FIG. 5.

The right-hand clamp R-1 is connected to the laterally inward end of a Siamese (or double) helically-wound, flexible, horizontally extending air hose 458 and 458*a*. The laterally outward end of these hoses are attached to fixedly positioned, rigid air lines 459 and 459*a* at the right side of the top carriage. A roller (not shown) suspends the inward end of the hose 458 from a horizontal trolley wire (not shown) above.

The other right-hand clamp R-2 is connected to the laterally inward end of a Siamese (or double) helically-wound, flexible, horizontally extending air hose 458 and 458*b*. The opposite end of this hose is attached to fixedly positioned rigid air lines (which are obscured in FIG. 5 by other parts of the apparatus) at the right side of the top carriage 32.

With this arrangement, the separate air supply lines to the clamp release cylinders on the individual clamps are kept as compact as possible and free from interference with any of the other parts of the apparatus within the top carriage 32 where they are located.

CONTROL CIRCUIT FOR ELECTRIC MOTORS

FIG. 25 illustrates schematically in simplified form the control circuit for the conveyor motor 337, the spreader belt motor 50, and the clamp positioning motor 135.

This control circuit includes a first relay coil 370 which operates a set of contacts 370*a* for controlling the energization of the conveyor motor 337 and a set of contacts 370*b* for controlling the energization of relay coil 371. The energization of the spreader belt motor 50 and the clamp positioning motor 135 is controlled by relay coil 371 which operates two sets of relay contacts 371*a* and 371*b*.

The conveyor motor 337 has a thermal overload 337*a* which operates a set of contacts 337*b*. The spreader belt motor 50 has a thermal overload 50*a* which operates a set of contacts 50*b*. The clamp positioning motor 135 has a thermal overload 135*a* which operates a set of contacts 135*b*. The respective thermal overload contacts 337*b*, 50*b* and 135*b* are closed normally (i.e., as long as the corresponding motors 337, 50 and 135 are not overloaded).

The relay coil 370 is in series with six switches and a resistor 372 across an 18 volt D.C. power supply. These six switches include a manual emergency switch 373 at the left-hand operator station at the entry side of the machine, a manual emergency switch 374 at the middle operator station, a manual emergency switch 375 at the right-hand operator station, a manual stop switch 376, a safety switch 500' associated with the spreader belts 41,42 at the left side of the machine, and the safety switch 500 associated with the spreader belts 43, 44 at the right side of the machine, as already described in detail. Normally, these six switches are all closed while the machine is in operation, and therefore relay coil 370 is energized and its two sets of contacts 370*a* and 370*b* are closed.

The conveyor motor 337 is under the control of an SCR motor controller 380 of known design. This motor controller has input terminals 381 connected to one phase of a 230 volt, 3-phase power supply 382 and output terminals 383 connected to the conveyor motor. The motor controller includes a start circuit having a 48 volt terminal 384, which is connected through the normally-closed thermal cutout contacts 337*b* and the normally-open relay contacts 370*a* to a terminal 385 of the motor controller which leads to a holding circuit therein. A first set of normally-open contacts 386 of a manually operated start switch is connected between the relay contacts 370*a* and an input terminal 387 of the motor controller 380 which is connected to a starting coil.

In the normal operation of the machine, relay coil 370 will be energized and its contacts 370*a* will be closed, the start switch contacts 386 will be open, and the thermal cutout contacts 337*b* for the conveyor motor will be closed. Under these circumstances, motor 337 will be energized if start switch 386 is closed momentarily.

If relay coil 370 is de-energized (by opening any one of the switches 373–376, 500' and 500 in series with it or a power failure, the relay contacts 370*a* will open, causing the conveyor motor 337 to be de-energized. After relay coil 370 is again energized, the start switch 386 must be closed in order to restart the conveyor motor 337. Therefore, even if the de-energization of the relay coil 370 is only momentary, the machine operator must close the start switch 386 manually in order to restart the conveyor 33.

The start switch has a second set of normally-open contacts 386' which are connected in series with the second set of relay contacts 370*b* operated by relay coil 370. The relay contacts 370*b* and the start switch contacts 386' are connected between one terminal of a 230 volt power supply 388 and one side of the relay coil 371. The opposite side of this relay coil is connected to the opposite terminal of this power supply through the normally-closed thermal overload contacts 50*b* of the spreader belt motor 50 and the normally-closed thermal overload contacts 153*b* of the clamp positioning motor 135 and a limit switch 389. Switch 389 is closed when the conveyor 33 is retracted and top carriage 32 moved back into position for automatic feeding of laundry work pieces by the spreader belts 41, 42 and 43, 44 and is open when the conveyor 33 is extended and the carriage is moved forward for hand feeding of short work pieces.

When energized, relay coil 371 closes its set of normally-open contacts 371*a*, which are in parallel with the start switch contacts 386'. The relay contacts 371*a* provide a holding circuit for keeping relay coil 371 energized after the start switch contacts 386' reopen.

The normally-open relay contacts 371*b* operated by relay coil 371 are connected in series with the spreader belt motor 50 and with the clamp positioning motor 135 across the power supply 392 through switch 390 and fuses 391.

In the normal operation of the machine, switches 373–376, 500' and 500 are all closed and relay coil 370 is energized. Consequently, the conveyor motor 337 is energized through the now-closed relay contacts 370*a*.

If switch 389 is closed (i.e., if the conveyor 33 is retracted in automatic feed position), the relay coil 371 will be energized through the now-closed relay contacts 370*b* when the start switch contacts 386' are closed. Consequently, the relay contacts 371*b* will be closed, completing an energization circuit for the spreader belt motor 50 and the clamp positioning motor 135 and the spreader belts 41, 42, 43 and 44 will operate, as described, as will the clamps operated by motor 135.

However, if switch 389 is open (i.e., if the conveyor 33 is extended) both the spreader motor 50 and the clamp positioning motor 135 will be de-energized.

CONTROL CIRCUIT FOR CLAMPS AT THE LEFT END

Figure 20:
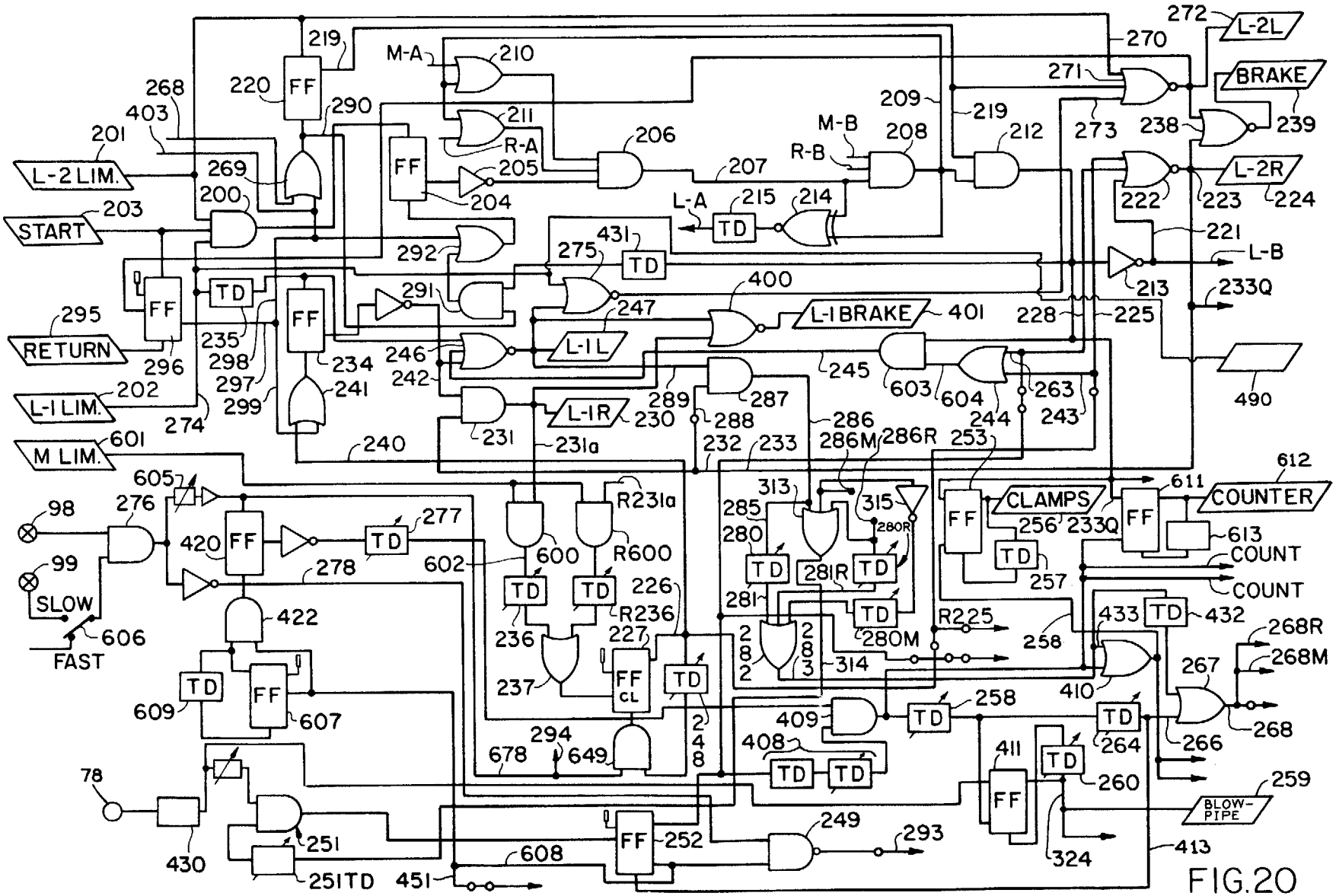
FIG. 20 is a schematic diagram of a control circuit for the apparatus.
Figure 21:
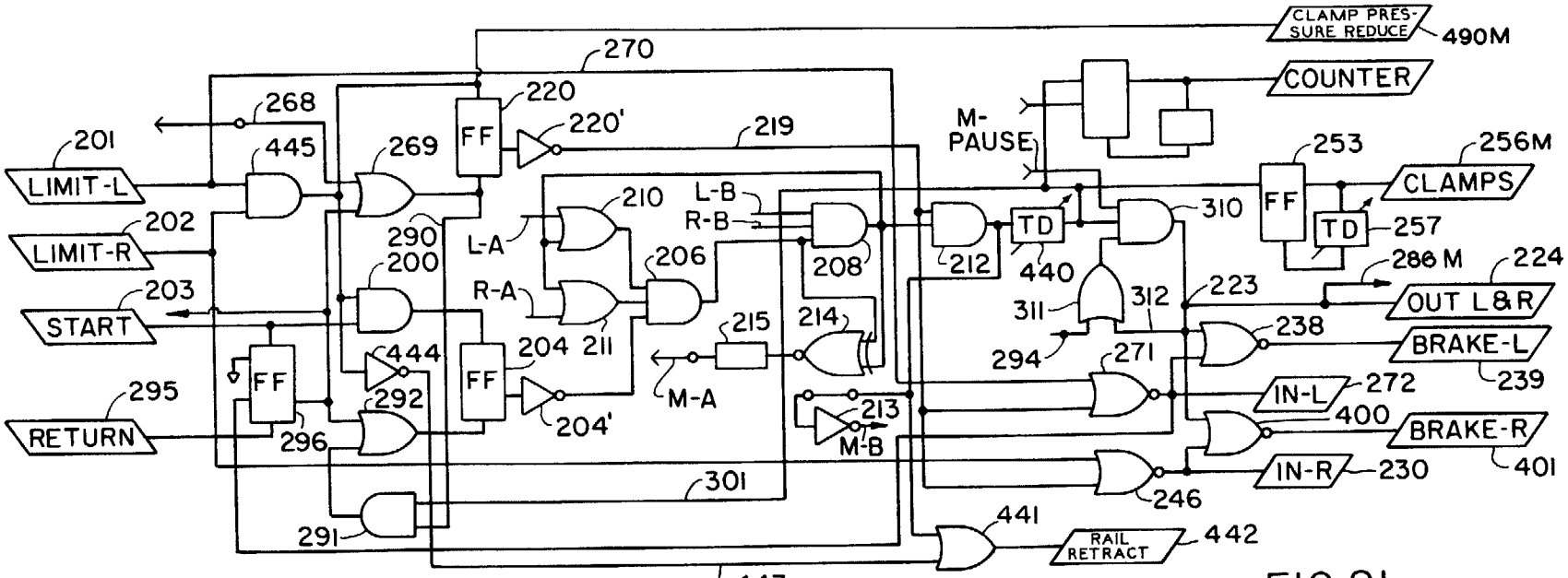
FIG. 21 is a schematic diagram of another portion of the control circuit.

FIG. 20 shows schematically the electrical circuit for controlling the spreading and release of the flatwork which is inserted into the left station clamps L-1 and L-2. The circuit for the flatwork inserted in the right station clamps R-1 and R-2 is the same. The circuit for the flatwork inserted in the middle clamps M-1 and M-2 is simpler and is shown in FIG. 21.

For convenience of description, the circuit elements and signals pertaining to clamps L-1 and L-2 will be referred to as being in the "left channel" and the circuit elements and signals pertaining to clamps R-1 and R-2 will be referred to as being in the "right channel", and the circuit elements and signals pertaining to clamps M-1 and M-2 will be referred to as being in the "middle channel".

Referring to FIG. 20, an AND gate 200 at the left side of this Figure is under the control of:

(1) a normally-open L-2 limit switch 201, which is closed when the inner clamp L-2 of the left pair is in its starting position to the left, as shown in FIG. 1;

(2) a normally-open L-1 limit switch 202, which is closed when the outer clamp L-1 of this pair is in its starting position, as shown in FIG. 1; and (3) a start switch 203 located at the left end of the machine for actuation by the operator there. The start switch 203 has three push buttons: "regular"; "tear"; and "stain". The latter two are for use by the operator when she detects a tear or a stain in the flatwork, in which case that flatwork will go through the present apparatus the same as a "regular" piece of flatwork having no such defect but will be rejected automatically later by equipment at the output side of the present apparatus.

When a start switch at 203 is closed Start/Return flip-flop 296 is set and if the limit switches 201 and 202 for both clamps are both closed, the AND gate 200 will set a Forward/Stop flip-flop 204 which sends an output signal via an inverter 205 to one input of an AND gate 206. Assuming that a start switch has not been closed already at either the middle channel or the right channel, the other two inputs to AND gate 206 will be high or "1", and the AND gate 206 will send an output signal via line 207 to one input terminal of an AND gate 208. Under the circumstances assumed, the other two inputs to gate 208 will be high.

The AND gate 208 now produces an output signal on a feedback line 209 which is connected to one input terminal of each of two OR gates 210 and 211. The outputs of these OR gates are, respectively, the second and third inputs to the AND gate 206, and the signal on line 209 will cause these OR gates to maintain these second and third inputs to the AND gate 206 high irrespective of the logic level of the other input signals to these OR gates. Therefore, the feedback signal on line 209 latches the AND gate 206 in the condition to which it was actuated initially by the left channel start signal on line 205.

The OR gate 210 has a second input at M-A which changes level in response to a center channel "A" signal. Similarly, the OR gate 211 has a second input at R-A which changes level in response to a right channel "A" signal. However, once the AND gate 206 has been latched, as described, neither a center channel "A" signal nor a right channel "A" signal can now interfere with or interrupt the left channel operation which was initiated by operating a left channel start button at 203, as described.

The left channel start signal at the output side of the AND gate 208 goes through an AND gate 212 and an inverter 213 to a line L-B.

The AND gate 208 in the left channel control circuit has two additional input lines M-B and R-B which come from the respective control circuits for the middle and right channels and which correspond to the output line L-B in the left channel circuit of FIG. 21.

ESTABLISHING PRIORITY OF OPERATION AMONG THE LEFT, RIGHT AND MIDDLE CHANNELS

If the left channel start switch was operated first, then the left channel "B" signal appearing at line L-B will inhibit the AND gate 208 in the right channel control circuit and will inhibit the AND gate 208 in the middle channel control circuit. Therefore, neither the right channel start signal nor the middle channel start signal can now get through to the output of its AND gate 208.

However, if the left channel start switch was operated second, for example, after the right channel start switch, then its AND gate 208 would be inhibited by the right channel signal at its R-B input and the signal on its input line 207 would be high and its output would be absent. These two signals are applied to the respective input terminals of an exclusive NOR gate 214 and the signal at the output of 214 will be low. After a time delay in the time delay circuit 215 this low will be applied as the left channel "A" signal on line L-A.

Line L-A is connected to an input of one of the two OR gates 210 and 211 in the right channel control circuit and the middle channel control circuit. The left channel "A" signal will not affect the previously "latched" right channel control circuit (under the conditions assumed) but it will disable the AND gate 206 in the middle channel control circuit. Thus, the second start signal (in the left channel) will now produce an "A" output signal which prevents the third start signal (in this instance, the middle channel "start" signal) from getting past the AND gate 206 in the middle channel control circuit just as the first "start" signal (in this instance, the right channel "start" signal) has produced a "B" signal which is preventing the second "start" signal (for the left channel) from passing through the AND gate 208 in the left channel control circuit.

With this arrangement, then, the first start switch that is operated (whether for the left channel, the right channel, or the middle channel) disables the operation of the second channel to have its start signal pass through gate 208, and the second similarly disables the third. Therefore, even if two or all three of the operators attempt to start their respective channels at about the same time, the first one started will finish most of its operation before the second begins, and the second before the third.

MOVING THE LEFT CHANNEL CLAMPS L-2 AND L-1 FROM THE LEFT END TO THE MIDDLE OF THE APPARATUS

The AND gate 212 has a first input connected to the output of AND gate 208 and a second input via line 219 from a "forward/reverse" flip-flop 220 which will provide a "1" on line 219 if the L-2 limit switch 201 has been operated properly. Normally this will be true, and the AND gate 212 will be enabled by the respective signals on its two inputs. The output signal from the inverter 213 is applied via line 221 to one input of a NOR gate 222 which has its output connected to the "L-2R" block 224. This block represents the control circuit for the clutch-brake unit 158 (FIG. 4) for the cable 146 which positions the inner left clamp L-2. When the correct signal is established at point 223 by the NOR gate 222, the inner left clamp L-2 begins to move to the right from its normal position near the left end of the apparatus over to a position at the middle of the apparatus.

The signal level at point 223 also depends on two other inputs to the NOR gate 222.

One of these inputs is connected via lines 225 and 226 to a flip-flop 227, which at this time establishes a low at this input.

The third input to the NOR gate 222 is connected via line 228 to a flip-flop 252, which establishes a low at this input until the "stretch" sensor 78 has been operated by the sheet or other piece of flatwork.

Therefore, with the inner left clamp L-2 at its normal position (to the left) and the left channel "start" signal having come through to the NOR gate 222, the latter will establish a high at point 223 to begin driving cable 146 clockwise in FIG. 4 to move the left inner clamp L-2 to the right, toward the middle of the apparatus.

The left outer clamp L-1 begins moving to the right at the same time as the left inner clamp L-2. This is done by actuating the clutch-brake unit 153 (FIG. 5) to drive cable 145 counterclockwise in FIG. 4. This is designated schematically by the "L-1 R" block 230 at the middle left in FIG. 20.

As shown in FIG. 20, such actuation of the "L-1 R" block 230 requires an output signal of the proper level from an AND gate 231. One input of this AND gate is connected via lines 232 and 233 to the output of the NOR gate 222. A second input of this AND gate is connected via line 242 and an inverter to a flip-flop 234, which is connected through a time delay circuit 235 to the L-1 limit switch 202, which is closed while the left outer clamp L-1 is in its normal position at the left end of the apparatus. Such closing of the outer limit switch 202 sets the flip-flop 234 to establish a high at the corresponding input of the AND gate 231. Then, when the correct level signal appears at point 223 for starting the left inner clamp L-2 to move in, this same signal enables the AND gate 231 to actuate the "L-1 R" block 230 for causing the left outer clamp L-1 to begin moving to the right, toward the middle of the apparatus, in unison with the left inner clamp L-2.

CLAMPS PAUSE AT THE MIDDLE OF THE APPARATUS

The signal that causes clamp L-1 to move toward the center of the machine also supplies one input to an AND gate 600. The second input to this gate is supplied when the middle limit switch 601 is actuated by the clamp L-2 reaching the center of the machine. Switch 601 is a proximity limit switch that senses a vane carried on the L-2 clamp carriage.

When both inputs are present to AND gate 600, an output appears at 602 which is applied to a time delay circuit 236. The time delay provided by 236 is adjustable to provide a fine adjustment (1 or 2 inches) of where the clamps stop at the center of the machine.

After time delay provided by 236 has expired, the signal is passed on to an OR gate 237 which sets the flip-flop 227.

When this happens, the NOR gate 222 is disabled via lines 226 and 225 and the actuating signal at point 223 for the "L-2 R" drive 224 disappears. Consequently, the inner left clamp L-2 stops moving to the right. Note that this "stop" signal at point 223 is applied to one input of a NOR gate 238, causing the latter to actuate the brake 239 in the clutch-brake unit for the drive cable 146 for the left inner clamp L-2, so that this cable is braked to a stop now. (The other input to the NOR gate 238 is the same as the input at 223 at this time.)

The disabling of NOR gate 222 also removes one enabling input to the AND gate 231 ahead of the "L-1 R" drive 230.

Also, when the flip-flop 227 is set it applies a signal via line 240 to an OR gate 241 for resetting the flip-flop 234, which now removes the other enabling input for the AND gate 231 on line 242. The purpose of flip-flop 234 is to control the direction of movement of clamp L-1.

The "L-1 R" drive 230 is disabled, de-clutching the counterclockwise drive for the cable 145 in FIG. 4, which had been moving the left outer clamp L-1 to the right. At the same time the brake actuating signal at the output of NOR gate 400 is applied to the brake 401 in the clutch-brake unit 153 for cable 145, so that it is braked to a stop simultaneously with the drive cable 146 for the left inner clamp L-2.

The setting of flip-flop 227 (by the OR gate 237, as described) also applies a signal via lines 226 and 243, through an OR gate 244, through line 604 to AND gate 603. The other input to AND gate 603 is high (1) since the output of AND gate 212 is high at this time. Therefore, the output of AND gate 603 is high and is passed by line 245 to one input of a NOR gate 246. The output of this NOR gate is connected to the "L-1 L" block 247

(FIG. 20) which controls the energization of the clutch-brake unit 153 for the cable 145. However, this input signal to the NOR gate 246 disables it from operating the "L-1 L" block 247 at this time. Therefore, the outer left clamp L-1 now pauses at its position near the middle of the apparatus.

The inner left clamp L-2 also is under the control of flip-flop 227 via lines 226 and 225 and NOR gate 222. The "L-2 R" block 224 at the upper right will be disabled, and the clamp L-2 will stop, in response to the setting of flip-flop 227 and it will remain disabled until flip-flop 227 is reset.

Therefore, the outer left clamp L-1 will stop at a location just to the left of the centerline of the machine and the inner left clamp L-2 will stop at a location just to the right of this centerline.

The duration of the clamps' "pause at the middle" is determined jointly by:

(1) an adjustable time delay circuit 248 which begins to time out in response to the setting of flip-flop 227; and (2) the actuation of the trailing edge sensor 98 or 99 (whichever is effective at this time) by the immediately preceding sheet (which has already been released by its clamps and blown onto conveyor 33).

The output of time delay circuit 248 is connected to one input of an AND gate 649, whose output is connected to a reset terminal of flip-flop 227. AND gate 649 has a second input via line 678 from the output side of a time delay circuit 605 connected to the output of the AND gate 276. This adjustable time delay provided by the time delay circuit 605 has the same effect as moving up or moving down the trailing edge sensor 98 or 99 whichever is effective at this time.

A switch 606 connected to one input of the AND gate 276 determines whether the lower trailing edge sensor 98 or the upper trailing edge sensor 99 is effective.

In the lower position of switch 606, it is connected to a line which is continuously at a high (logic 1) potential. In this setting of the switch, whenever the trailing edge of the laundry piece moves up past the lower photocell 98, the latter will produce a logic 1 signal to the other input of AND gate 276, causing its output to go high. This lower position of switch 606 is used for higher speed operation of the conveyor 33.

In the upper position of switch 606, the AND gate 276 receives its first logic 1 input signal from the lower photocell 98 when the trailing edge of the laundry piece moves up past it. The AND gate 276 receives its second logic 1 input signal from the upper photocell 99 when the trailing edge of the laundry piece moves up past it. When this happens, the output of the AND gate 276 goes high. This upper position of switch 606 is used for lower speed operation of the conveyor 33.

The time delay circuit 248 may be set to time out after 0.1 or 0.2 second, typically, and this determines the minimum duration of the clamps' pause at the middle. For example, if there is no preceding piece of flatwork in the machine or if it is a short piece, the pause at the middle will be determined by the time delay circuit 248. Usually, however, there will be a preceding flatwork piece being pulled forward by the conveyor 33, but with its trailing edge not yet past the trailing edge sensor 98 or 99 which is effective at that time. In that case, the AND gate 649 will not be enabled until substantially immediately after the trailing edge of the preceding flatwork piece moves up past the trailing edge sensor 98 or 99 whichever is effective.

MOVEMENT OF CLAMP L-1 FROM THE MIDDLE TO THE LEFT

MOVEMENT OF CLAMP L-2 FROM THE MIDDLE TO THE RIGHT

When the flip-flop 227 is reset, its output signal via lines 226 and 243, the OR gate 224, line 604, and gate 603, and line 245 enables the NOR gate 246. A second input to this NOR gate is connected to the output line 242 from flip-flop 234 through an inverter. Flip-flop 234 was reset when flip-flop 227 was previously set but is unaffected by the resetting of flip-flop 227. A third input to the NOR gate 246 is from the L-1 limit switch 202, and this input now is low. All input signals to the NOR gate 246 are low, thus enabling it, and its output now actuates the "L-1 L" block 247 so that the cable 145 is now driven clockwise in FIG. 4 to move the outer left clamp L-1 from near the middle of the apparatus back over to the left.

The resetting of the flip-flop 227 after the time delay also enables the NOR gate 222 again via lines 226 and 225, so that the "L-2 R" block 224 is actuated again and the "L-2 Brake" block 239 is disabled. Consequently, the clockwise drive to the cable 146 for the inner left clamp L-2 in FIG 5 is re-established and this clamp again begins moving to the right (from near the middle of the apparatus toward its right end).

STOPPING THE OUTWARD MOVEMENT OF CLAMPs L-1 and L-2

When the top edge of the flatwork held by the two outwardly-moving clamps L-1 and L-2 moves up past the "stretch" sensor 78, this sensor (at the lower left corner of FIG. 20) enables an adjustable time delay circuit 430. When the delay is completed, the signal is passed on to AND gate 251, the output of which triggers a flip-flop 252.

A time delay circuit 251 TD also controls AND gate 251 to prevent the flip-flop 252 from being triggered by the movement of clamps L-1 and L-2 past this sensor. Beginning when the clamps start moving apart until the time delay in circuit 251 TD has been completed, the "stretch" sensor is inoperative in effect because the AND gate 251 is disabled. The triggering of flip-flop 252 causes NOR gate 222 to be disabled via line 228. This action of NOR gate 222 disables the "L-2 R" block 224 and enables the "L-2 Brake" block 239. Therefore, the movement of the inner left clamp L-2 to the right is stopped.

Also, this disabling signal on line 228 is applied via line 263 through the OR gate 244, line 604, AND gate 603, and NOR gate 246, disabling the latter so as to disable the "L-1 L" block 247 and enable brake block 401. Therefore, the movement of the outer left clamp L-1 to the left also is stopped.

FLATWORK RELEASED BY CLAMPS L-1 AND L-2 AND BLOWN ONTO CONVEYOR 33

The output of flip-flop 252 is connected through the "Pause Before Release" time delay circuit 408 to one input terminal of an AND gate 409. The other input terminal of AND gate 409 is connected to the output of a "sheet overlap" time delay circuit 277 associated with a flip-flop 420 at the output side of AND gate 276. Flip-flop 420 is set in response to the actuation of the effective trailing edge sensor 98 or 99, as described, and circuit 277 begins to time out. Assuming that the spacing between the leading (top) edge of the present sheet and the trailing (bottom) edge of the immediately preceding sheet is sufficient, so that time delay circuit 277 has timed out, the AND gate 409 will be enabled when flip-flop 252 has been triggered in response to "stretch" sensor 78 and after the time delay provided by 408 has elapsed.

The output of AND gate 409 is connected to an OR gate 410 (at the lower right in FIG. 20), which is enabled in response to the enabling of AND gate 409. The output of OR gate 410 is connected via line 255 to flip-flop 253, so that flip-flop 253 is operated in response to the enabling of OR gate 410. When this happens, flip-flop 253 actuates the clamps L-1 and L-2 to release the sheet. (This is done through the air cylinder 87 for each clamp, as already explained.) The clamp-release circuitry is designated schematically by the block 256 in FIG. 20. A time delay circuit 257 associated with the flip-flop 253 restores it after a suitable time interval so as to restore the clamps to their normal condition following their release of the sheet.

The time interval between the operation of the stretch sensor 78 and stopping of the clamp carriages depends upon the adjustment of the time delay circuit 430. The adjustablility of this time interval enables the tension on the sheet between the clamps at the time of its release to be adjusted. This adjustment is made whenever possible by adjusting the beam of 78 higher or lower on the reflector because addition of time delay by 430 causes narrow flatwork not to be stretched as tightly as wide pieces.

The AND gate 409 also controls the actuation of the blow-pipes B-1, B-2 and B-3 for blowing onto the conveyor 33 the flat-work piece which has just been released by the left clamps L-1 and L-2. The output of AND gate 409 is connected through an adjustable time delay circuit 258 to trigger a flip-flop 411 which operates the block 259 which designates schematically in FIG. 20 the blowpipes B-1, B-2 and B-3 and their electropneumatic controls.

The duration of the air blasts from these blowpipes is determined by an adjustable time delay circuit 260, which is connected between the output of flip-flop 411 and its reset input, which causes the flip-flop to reset after a time delay in time delay circuit 260, thus turning off the blowpipes.

The output of AND gate 409 is also connected to flip-flop 611 and will trigger it, provided line 233Q (the data input to flip-flop 611) is high. Since this is true from the time that the clamps begin their movement until they start back to the station after blow down of the sheet, the flip-flop 611 will be triggered each time a sheet is fed from the left station and successfully blown down onto the conveyor.

An electro-mechanical counter is represented by block 612 in FIG. 20. This is operated each time a pulse output comes from flip-flop 611. The length of the pulse depends on the time delay provided by a time delay circuit 613 through which the output signal resets 611.

The output of time delay circuit 258 is connected to an adjustable "Pause After Release" time delay circuit 264 whose output is connected via line 413 to flip-flop 252 to reset the latter after circuit 264 times out.

Resetting flip-flop 252 sets flip-flop 607 through line 608 and supplies a signal to AND gate 422. The other input to AND gate 422 is supplied from flip-flop 607, which resets itself after a 0.1 second time delay provided by a time delay circuit 609. Thus, the output of AND gate 422 will be a 0.1 second pulse whenever flip-flop 252 is reset. This pulse output from AND gate 422 resets flip-flop 420. This inhibits the blowpipes from operating until the trailing edge passes the trailing edge sensor 98 or 99 which is effective at this time and the "sheet overlap" time delay 277 times out.

RETURN OF CLAMP L-2 FROM RIGHT END TO LEFT END OF APPARATUS

After the time delay circuits 258 and 264 time out, the OR gate 267 is enabled via line 266 to apply a signal through a "reverse" line 268 which extends to one input of an OR gate 269. This signal through the OR gate 269 reverses the "forward/reverse" flip-flop 220, thereby making its output on line 219 low and the output from the AND gate 212 low. This logic level change at the output of AND gate 212 produces the signal at line 221 for disabling the NOR gate 222.

The reversal of the flip-flop 220 also produces an output signal on line 219 which is applied to a NOR gate 271 to actuate the "L-2 L" block 272. This block represents schematically the reversing clutch for cable 146 (FIG. 5) which now drives this cable counterclockwise in FIG. 5 to move the left inner clamp L-2 from the right end of the apparatus toward the left. The signal at the output of the NOR gate 271 at this time causes the NOR gate 238 to release the L-2 brake 239 which had been applied to hold the cable 146 stationary.

For the NOR gate 271 to be enabled by the signal on line 219, as described, its two other inputs must be "low" also. One of these is the signal on line 270, which is low unless clamp L-2 is back at its starting position. The remaining input on line 273 has the proper level if either of the following two conditions is met:

(1) the outer left clamp L-1 is back in its starting position at the left end of the apparatus, holding the limit switch 202 closed and thereby providing the proper signal polarity on the input line 274 to a NOR gate 275 whose output is connected to line 273; or (2) the "L-1 L" block 247 is energized, which means that the outer left clamp L-1 is moving to the left.

ENABLING NEXT CHANNEL TO OPERATE

The clamps for the next channel cannot move until the inner left clamp L-2 begins its return from the right end of the apparatus over to its starting position at the left end. This happens, as described, in response to a "reverse" signal on line 268.

This "reverse" signal passes through the OR gate 269 and is applied via line 290 to one input of an AND gate 291. A second input to this AND gate is from the output of AND gate 212 through a time delay circuit 431. With both inputs to the AND gate 291 now high, this AND gate delivers a reset signal via OR gate 292 to reset the flip-flop 204. This disables the AND gate 206 which, in turn, disables the AND gate 208 in the channel priority circuitry in the left channel control circuit of FIG. 20. Therefore, the signal L-B at the outlet side of the inverter 213 in the left channel control circuit goes high and no longer inhibits the operation of the next channel in order. The second channel to have its start button pushed would have a low on equivalent "A" line. As this second channel started its "A" signal would go high, allowing the third channel to have its start button pushed to have its signal move up to its line 207.

Consequently, if, for example, the next channel to operate is the right channel, its clamps R-1 and R-2 can now begin moving from their starting positions at the right end of the machine over to the middle of the machine because the inner left clamp L-2 will be out of their way, moving to the left.

If the next channel is the middle channel, then there is no initial movement of its clamps M-1 and M-2 to the middle of the apparatus because that is their starting position, so they immediately begin to move apart when the trailing edge photocell 98 or 99 (whichever is effective) sees the trailing edge of the previous sheet and time delay 605 has expired.

TRAILING EDGE DETECTED

As already explained, the operation of the left channel all this time has inhibited whichever of the other two channels (right or middle) is next in the order of operation, as determined by the order in which the respective start switches for the different channels were closed.

The AND gate 276 is controlled by one of the trailing edge sensors 98 or 99, as described, and its output is connected via an inverter and line 278 to one input of the AND gate 249. The second input to this gate is from the inverted output of flip-flop 252. This output occurs after the "pause after release" has occurred, that is, when the flip-flop is reset.

At the time that the piece of flatwork is blown onto the conveyor and the clamps start to return to their station and the sheet is covering the "trailing edge" sensors 98 and 99, both inputs to gate 249 are high (1) so that the output of this gate is low. This signal will go high when the "trailing edge" sensor 98 or 99 whichever is effective at this time is uncovered, resulting in a signal that switches from 0 to 1 at the output of gate 249. This signal will be discussed later in connection with the "Quality Control Circuit".

As already explained, the flip-flop 227 is part of the "pause at the middle" circuitry for the left channel which performs this control function for the clamps L-1 and L-2 after they have moved together from the left over to the middle of the apparatus.

FIG. 20 shows a second time delay circuit R 236 connected to the input of flip-flop 227 through the OR gate 237. R 236 is part of the right channel control circuit (which is identical to the left channel control circuit) and it has its input connected via AND gate R 600 to a line R 231*a* in the right channel circuit which is the counterpart of AND gate 600 and line 231*a* in the left channel circuit.

If the right channel is in operation before the left channel flatwork has moved up past the effective trailing edge sensor 98 or 99 (which is possible because the right channel clamps R-1 and R-2 can begin moving to the left from their starting position at the right end toward the middle of the apparatus), there will be an enabling signal on line R 231*a* in the right channel control circuit. After the clamps have reached center, as sensed by centering limit switch 601, the signal is high (1) on both inputs of gate R 600.

This starts the time delay circuit R 236, which times out after an inch or two of clamp movement which is adjusted so the clamps are centered on the center of the machine.

The output signal from R 236 now operates the flip-flop 227 the same as it was operated by the output signal from the corresponding left channel time delay circuit 236. After the "pause at the middle" interval determined by the time delay circuit 248, the latter delivers an enabling signal to one input of an AND gate 649. A second enabling signal at the other input of this AND gate appears on line 678 in response to effective trailing edge sensor 98 or 99 being uncovered by the previous piece of flatwork being fed.

Therefore, with the right channel clamps R-1 and R-2 at the middle of the apparatus, the flip-flop 227 will be reset through the AND gate 649 in response to the movement of the left channel flatwork up past the effective trailing edge sensor. This operation of the flip-flop 227 produces a signal on line 226 and the branch line R 225 in the right channel control circuit which is the counterpart of line 225 in the left channel control circuit of FIG. 20. In response to this signal on line R 225, the right channel clamps R-1 and R-2 will move out to the left and right from their pause position at the middle of the apparatus so as to spread the leading edge of the right channel flatwork. The foregoing description assumed that the right channel was next to operate after the left channel.

However, if the middle channel is next to operate after the left channel, then the flip-flop 227 will not be operated by the right channel time delay circuit R 236 as just described. Instead, the signal from the effective trailing edge sensor will be applied via line 294 to the middle channel control circuit (FIG. 21). The two middle channel clamps M-1 and M-2 start at the middle of the apparatus, and after this signal appears on line 294, indicating that the trailing edge of the left channel flatwork has moved up past the effective trailing edge sensor, these middle clamps can be spread apart, as explained hereinafter with reference to FIG. 21.

MISFEED

If a piece of flatwork was not inserted in the left channel clamps L-1 and L-2, or has dropped out of either or both of these clamps, of if the diagonally opposite corners are fastened in the clamps, then the "stretch" sensor 78 will not be actuated as the clamps move out from the middle of the apparatus to the left and right, respectively. Therefore, this sensor cannot trigger the stopping of the outer left clamp L-1 and the reversal of the inner left clamp L-2, as previously described.

This control function will be achieved through a left channel misfeed time delay circuit 280 (at the lower middle of FIG. 20), whose output 281 is connected to one input of an OR gate 282. The output 283 of this OR gate is connected through a time delay circuit 432, which provides a 0.01 second time delay, to one input of the previously mentioned OR gate 267. As already explained, the output of OR gate 267 is connected via line 268 and OR gate 269 to the "forward/reverse" flip-flop 220 for reversing the direction of the inner left clamp L-2.

Also, the output of OR gate 282 is connected via lines 283 and 433 to one input of OR gate 410, so that the clamps will release the sheet immediately upon the enabling of OR gate 282 (and slightly before the clamp movements are reversed.)

The input of the left channel misfeed time delay circuit 280 is connected via lines 285 and 286 to the output of an AND gate 287. One input 288 of the AND gate 287 is connected via lines 232 and 288 to the output 223 of the NOR gate 222. The other input 289 of the AND gate 287 is connected to the output of the NOR gate 246.

With this arrangement, the AND gate 287 is enabled while the other left clamp L-1 is moving out to the left and the inner left clamp L-2 is moving out to the right. This starts the time delay circuit 280, and after a time interval long enough for the two clamps to have moved substantially all the way out, this delay circuit produces an output signal at 281 which goes through OR gate 282, time delay circuit 432 and OR gate 267 to line 268 for reversing the flip-flop 220. This reversal of flip-flop 220

(1) disables the NOR gate 222 (as described in the section headed "Return of Clamp L-2 from Right End to Left End of Apparatus") to disable the L-2R drive 224 and actuate the L-2 brake 239, thereby preventing the inner left clamp L-2 from continuing to move out to the right, and (2) enables the NOR gate 271 to actuate the "L-2 L" block 272, for reversing the drive to the inner left clamp L-2 so as to bring it back to the left end of the apparatus.

Slightly later, the outer left clamp L-1 in moving to the left will have closed its limit switch 202, thereby disabling the NOR gate 246 and stopping the "L-1 L" drive 247 so that the outer left clamp L-1 will stop moving out to the left.

When the leftward-moving inner left clamp L-2 closes its limit switch 201, this disables the OR gate 271 and de-energizes the "L-2 L" drive 272 for cable 146 in FIG. 5. At the same time, the NOR gate 238 is enabled for operating the brake 239 for this cable.

Consequently, both clamps L-1 and L-2 are now stopped at their starting positions at the left end of the apparatus.

The right channel control circuit has a time delay circuit 280R in FIG. 20, with its input from a line 286R extending from the output of an AND gate corresponding to AND gate 287, and its output on line 281R going to a second input of OR gate 282.

CLAMP RETURN

The operator may bring back her clamps after she has operated one of her start buttons. Assuming that she decides to do this after the clamps L-1 and L-2 for this flatwork have been displaced from their starting positions at the left end of the apparatus, when she momentarily closes the "return" switch 295 in FIG. 20, this resets the "start/return" flip-flop 296.

This flip-flop, via lines 297 and 298, enables OR gate 269, which resets flip-flop 220. Through the NOR gate 271 the flip-flop 220 now actuates the "L-2 L" block 272 to bring the inner left clamp L-2 back to the left.

Flip-flop 296 also resets flip-flop 234, via lines 297 and 299 and OR gate 241, to actuate the "L-1 L" block 247 to bring the outer left clamp L-1 back to the left.

Figure 22:
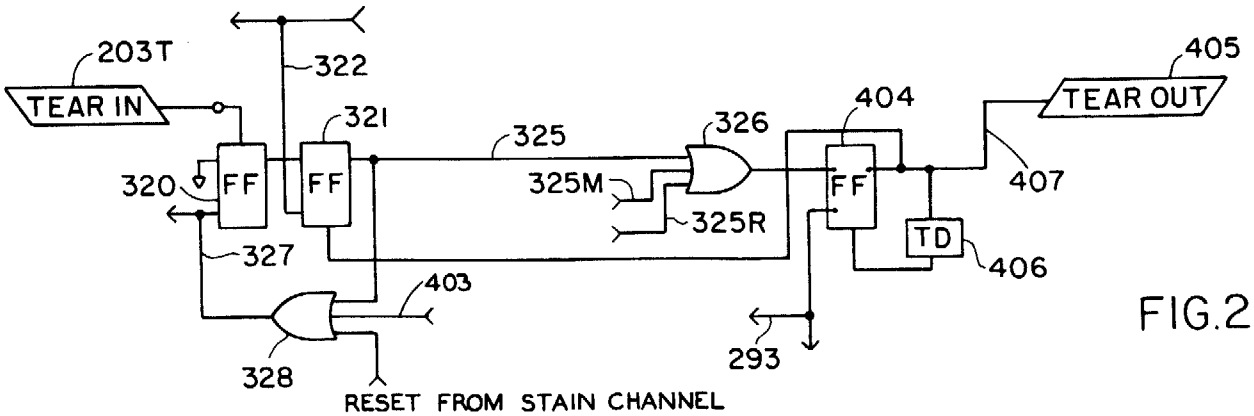
FIG. 22 is a schematic diagram of still another portion of the control circuit.

The operation of the "return" switch 295 also cancels out any quality control designations (i.e., "Tear" or "Stain") which the operator may have included by the signal on line 403 to the quality control section (FIG. 22).

The operation of a "clamp" button causes the clamps to release the sheet which had been inserted by the operator. This is effected through circuitry which does not appear in FIG. 20.

Also, the machine is provided with a "stop" switch which causes all three pairs of clamps to release their respective sheets and all three return "buttons" to be effectively operated.

MIDDLE CHANNEL CONTROL CIRCUIT

FIG. 21 shows schematically the control circuit for the middle clamps M-1 and M-2. Elements in this Figure which correspond to those in the end channel control circuit of FIG. 20 are given the same reference numerals, and the detailed description of these elements and their functions will not be repeated.

FIG. 21 is substantially simpler than FIG. 20 because the clamps M-1 and M-2 have less complicated movements. They are both stationary at the middle, or moving apart, or stationary near the opposite ends of the apparatus, or moving toward each other. They do not move in the same direction at any time. As a consequence, the control circuitry for these middle station clamps is substantially simpler than the control circuitry for either pair of end channel clamps.

With both middle clamps M-1 and M-2 at their middle positions, the limit switches 201 and 202 in FIG. 21 will be closed, thereby enabling an AND gate 445 which triggers a flip-flop 220 to provide an enabling signal via an inverter 220' and line 219 leading to one input of an AND gate 212.

When the operator now presses one of the three push buttons for the start switch at 203, the AND gate 200 will be enabled and will set the "forward/stop" flip-flop 204. This flip-flop will enable the AND gate 206 via an inverter 204', provided there is no inhibit signal at the L-A input to OR gate 210 or at the R-A input to OR gate 211. The output from AND gate 206 will enable the next AND gate 208, provided there is no inhibit signal on the latter's L-B input or R-B input. The AND gate 208 now provides a second enabling input to the AND gate 212, so that AND gate 212 now is enabled (provided both middle clamps are properly positioned at the middle channel loading station).

The output from the AND gate 212 supplies one enabling input to an AND gate 310 through an adjustable time delay circuit 440, which preferably provides a time delay of about 1.0 second.

The output from the AND gate 212 also is applied through an inverter 213 to a line designated M-B, which provides the M-B inhibit input to the AND gate 208 in each of the left and right channel circuits.

The output from AND gate 212 also is applied through an OR gate 441 to a block 442, which represents schematically the mechanism for returning the middle clamps forward toward the conveyor 33 at the entry side of the apparatus, so that the middle clamps are not rearwardly offset from the end clamps as much as they were when the operator was inserting the laundry piece into the middle clamps.

The output from the time delay circuit 440 at the output side of AND gate 212 is applied via line 301 to one input of an AND gate 291, but at this time the signal on line 290 disables the AND gate 291.

The AND gate 310 has a second input from flip-flop 252 (FIG. 20) via lines 608 and 451. As already explained, flip-flop 252 produces this signal after the stretch sensor 78 senses that the top edge of the flatwork stretched out.

A third input to the AND gate 310 is from OR gate 311. One of its inputs is line 294. As already explained in the section headed "Trailing Edge Detector", a signal of the proper level appears on line 294 following the passage of the trailing edge of the preceding piece of flatwork up past the effective trailing edge sensor 98 or 99. Consequently, the AND gate 310 will be enabled at a time when the flatwork will not interfere with, or be interfered with by, the preceding flatwork.

When the AND gate 310 is enabled it energizes the block 224 designated "out right and left" in FIG. 21. This represents the forward clutches for both cables 111 and 115 in FIG. 5, so that both clamps M-1 and M-2 now move laterally outward, to the left and right, respectively. The time delay circuit 440 has delayed this spreading of the middle clamps long enough for these clamps and their support rails to have moved rearward to their operating positions.

A feedback line 312 from the output of AND gate 310 to a second input of the OR gate 311 maintains the latter enabled even after the trailing edge input signals to its first input 294 is no longer present.

The enabling of AND gate 310 also applies a signal via line 286M to one input of an OR gate 313 in the control circuitry in the center of FIG. 20. This OR gate has a second input via line 286 from the AND gate 287 of the left channel control circuit and a third input via line 286R from the same AND gate in the right channel control circuit. Accordingly, the OR gate 313 will be enabled whenever any pair of clamps L-1 and L-2, M-1 and M-2, or R-1 and R-2, are moving apart.

The output signal from the OR gate 313 is applied via line 314 through the time delay circuit 251 TD to the AND gate 251. As already explained, the AND gate 251 is enabled in response to the actuation of "stretch" sensor 78 when the flatwork is spread apart by the outwardly moving clamps after the time delay in circuit 251 TD has timed out.

As already explained, the actuation of the "stretch" sensor causes the outwardly-moving clamps to be operated to release the flatwork and actuates the blowpipes to blow the released flatwork onto the conveyor 33. When the middle channel is in operation, these control functions are effected by the circuit elements shown in FIG. 21 and described under the previous heading "Flatwork Released by Clamps . . . and Blown onto Conveyor 33".

The same is true for "Stopping the Outward Movement of Clamps". The outwardly-moving clamps M-1 and M-2 are stopped automatically by disabling block 224 in FIG. 21 and enabling blocks 239 and 401 via NOR gates 238 and 400, respectively, to apply the brakes for the M-1 and M-2 cables 115 and 111 in FIG. 5.

When the flatwork has been blown onto the conveyor there is a short adjustable pause in time delay 264 before line 268M goes high. The signal path is line 266, OR gate 267, line 268M (FIG. 20), line 268 (FIG. 21), OR gate 269, line 290, and flip-flop 220 (resetting it). Flip-flop 220 actuates the "in left" block 272 and the "in right" block 230 through NOR gates 271 and 246 in the same manner as described in detail for the left channel. The "in left" block 272 and the "in right" block 230 in FIG. 21 represent schematically the reverse clutches for the cables 111 and 115 in FIG. 5. Consequently, the direction of these cables is reversed and both clamps M-1 and M-2 are moved back toward the middle of the apparatus.

In FIG. 20, a "misfeed" time delay circuit 280M is connected to the input line 286M from the center channel circuit (FIG. 21) through an inverter 315. The output of this time delay circuit 280M is connected to a second input of the OR gate 282 for the purpose of automatically reversing the outwardly-moving middle clamps M-1 and M-2 in the event of a misfeed of the middle channel sheet. The enabling of the OR gate 282 will produce a signal on line 268M in FIGS. 20 and 21 for reversing the flip-flop 220 to reverse the drive to cables 111 and 115.

As already explained, the middle clamps and their support rails 100-1 and 100-2 are retracted to the operating (reverse) position in response to the closing of start switch 203 for the middle channel.

If either middle clamp is not at its loading position along the respective support rail 100-1 or 100-2, then the pneumatic retraction device 442 for these support rails will be actuated through OR gate 441 from line 443 at the output side of an inverter 444. The input side of the inverter is connected to the output of an AND gate 445 having its respective inputs connected to the limit switches 201 and 202 for the middle clamps. Accordingly, the middle clamps will not be displaced toward the operator for convenience in loading them unless they are at the correct positions along their respective support rails.

Also, the middle clamps cannot begin to spread apart if either of them is not properly positioned at the middle channel loading station (holding the corresponding limit switch 201 or 202 closed) because in that event the AND gate 200 would not be enabled.

QUALITY CONTROL CIRCUIT

FIG. 22 shows a portion of the quality control circuit in the present system. As already mentioned, if the operator notices a tear or a stain in the sheet or other piece of flatwork, she may operate the correspondingly labeled pushbutton in the start switch 203 at her station. This will permit the defective flatwork to go through the present apparatus the same as a perfect piece of flatwork, but be rejected later, such as in a folder at the outlet side of the present apparatus.

FIG. 22 shows the quality control circuitry pertaining to a "tear" defect in the left channel flatwork.

The block 203T represents schematically the "tear" contacts of the operator's start switch. When closed, these switch contacts set a flip-flop 320, and the output of this flip-flop is the data input of a flip-flop 321.

The signal on 322 will now set the flip-flop 321 to produce an output signal on a line 325 leading to one input of an OR gate 326. This OR gate has two other inputs, on lines 325M and 325R, which are the lines in the middle channel and right channel quality control circuitry corresponding to line 325 in the left channel quality control circuitry.

Thus, the OR gate 326 will be anabled by a "tear" input signal for the left, middle or right channel, followed by the counter operating.

The output of flip-flop 321 is applied via OR gate 328 and line 327 to reset the flip-flop 320, so that the latter becomes ready to receive another quality control input signal.

Flip-flop 321 is maintained in its set condition until the trailing edge of this piece of flatwork is detected by the "trailing edge" sensor. When the trailing edge is detected, a signal appears on line 293 which sets flip-flop 404, provided a "tear" signal is present at 325, 325M or 325R. Line 407 connects the output of flip-flop 404 to the "tear" output 405 feeding the external quality control equipment. This signal also is passed through time delay 406 and after a 0.1 second resets flip-flop 404.

The operation of the "stain" channel is identical to that of the "tear channel."

Thus, for a "tear" or "stain" signal to be delivered to the apparatus which can reject the defective flatwork, the following conditions must have occurred:

(1) the operator has closed the "tear" or "stain" start switch contacts at 203;

(2) the clamps have moved out;

(3) the "stretch" sensor 78 has been actuated; and (4) the "trailing edge" sensor has been operated.

Figure 26:
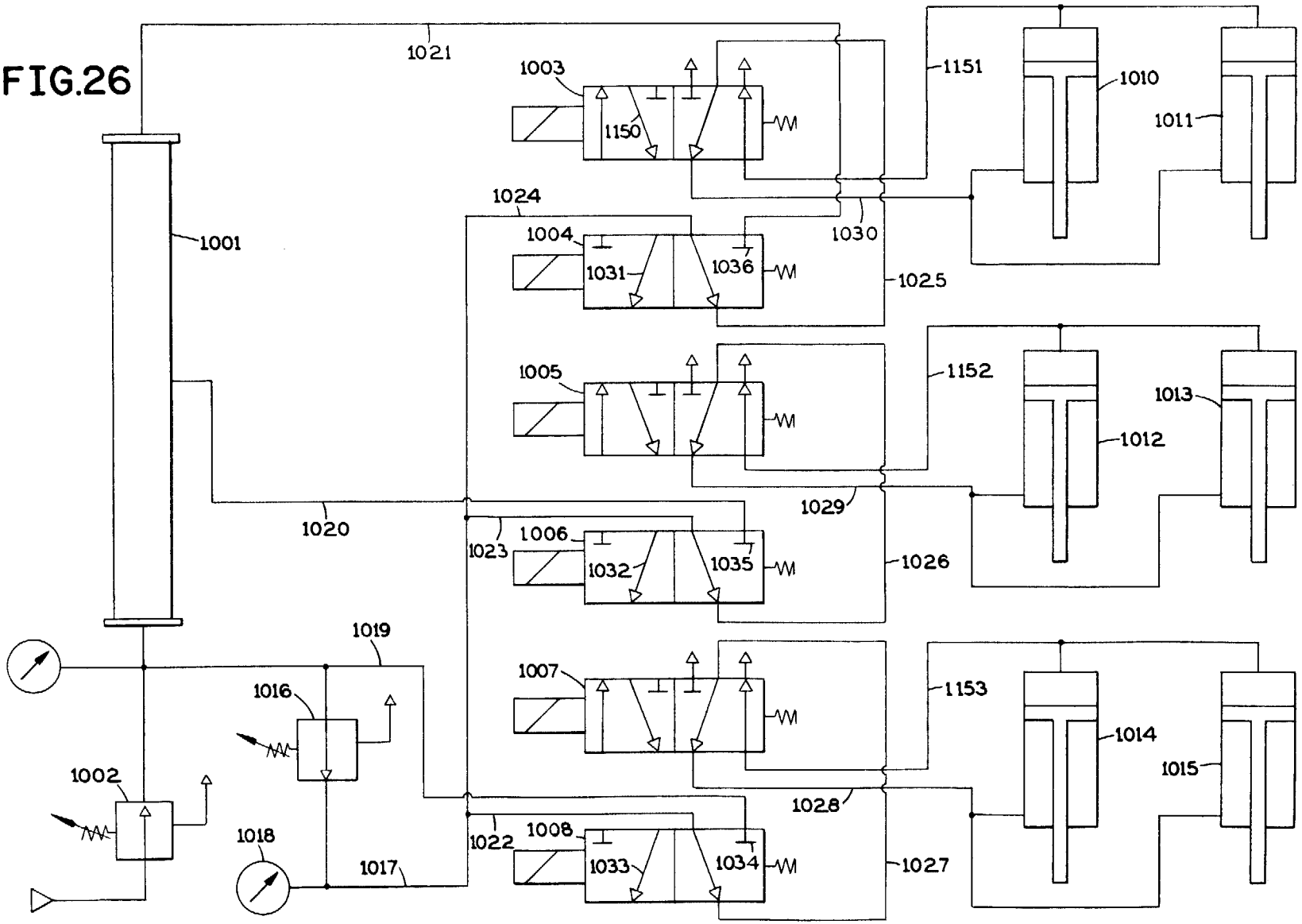
FIG. 26 is a schematic diagram of a pneumatic system.

FIG. 26 shows a schematic diagram of the pneumatic system of the part of the apparatus that controls clamp control. Accumulator tank 1001 is a high pressure air storage reservoir which receives high pressure air through a high pressure regulator 1002. There are six solenoid valves 1003–1008. At the right side of FIG. 26, there are three pairs of actuating cylinders 1010–1015. From the high pressure reservoir 1001, high pressure air is reduced by a low pressure regulator 1016 which supplies low pressure air to a supply line 1017 which is read by a meter 1018. High pressure is applied over three lines 1019, 1020 and 1021.

Low pressure lines 1022, 1023 and 1024 lead to valves 1008, 1006 and 1004 respectively. In the de-energized condition of the solenoid valves shown in the drawings, low pressure air is fed through the valves to lines 1025, 1026 and 1027. These lines feed air through valves 1007, 1005 and 1003 via lines 1028, 1029 and 1030 to the lower side of the pneumatic cylinders 1010–1015. With low pressure on the cylinders, the clamps of the apparatus are in a low pressure clamping condition where they grip the article only reasonably lightly so that it is relatively easy to insert and remove articles.

When valves 1008, 1006 and 1004 are energized by the circuit of FIG. 27 as will be explained, these valves shift to the right as viewed in the drawings until the passageways 1031, 1032 and 1033 line up with orifices 1034, 1035 and 1036. In this condition, high pressure air is supplied from lines 1019, 1020 and 1021 through the valves to the cylinders 1010–1015. The low pressure air is off. The cylinders then cause the clamps to exert more force on the article for holding it more tightly, and this condition occurs when the clamps are away from their home station such as when the article is being spread. Thus, a heavy or wet article will not tend to be pulled from the clamps.

Figure 27:
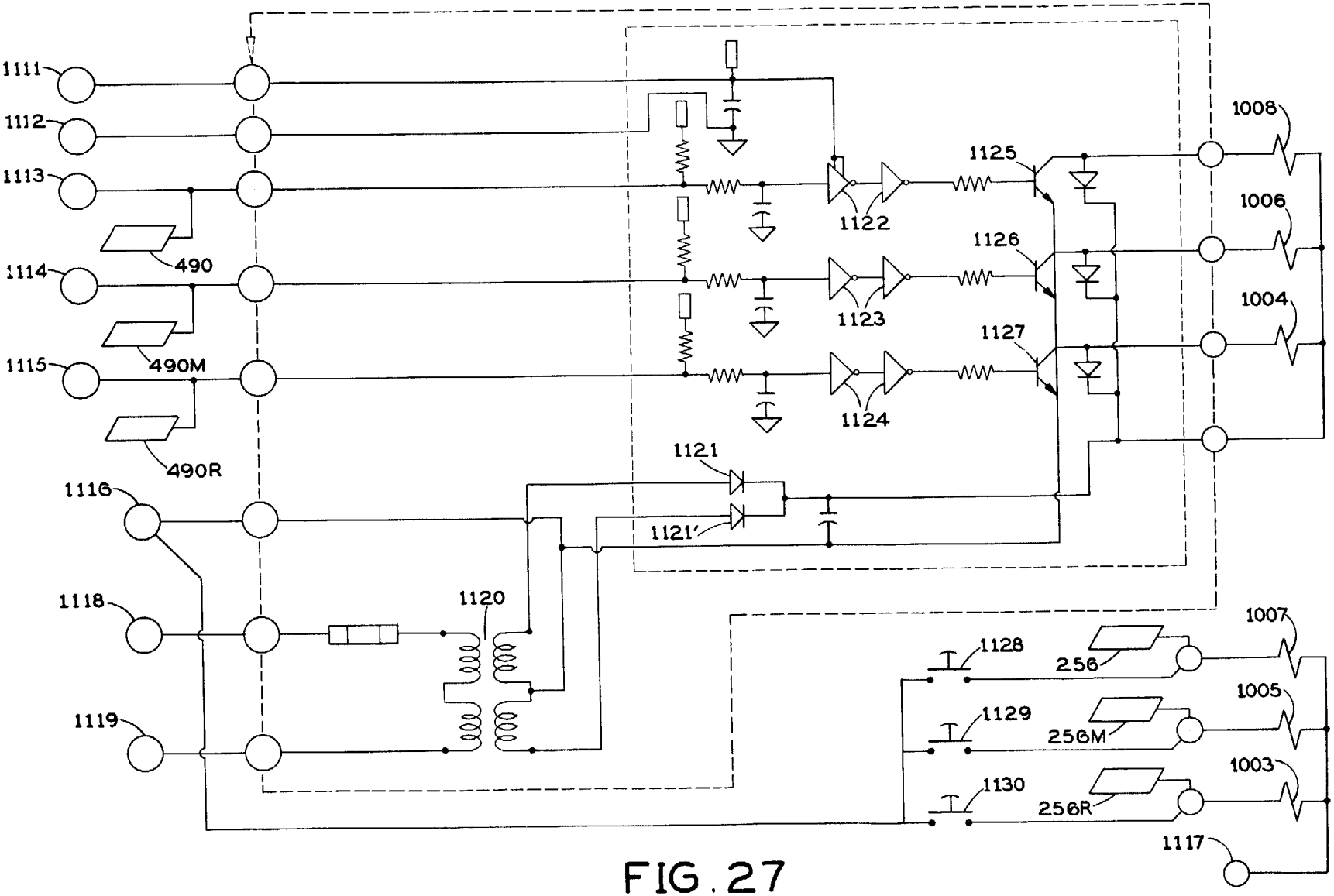
FIG. 27 is a circuit diagram of a control circuit for the pneumatic system.

FIG. 27 shows the electrical schematic diagram for operating the pneumatic circuit just described. Terminals 1111 and 1112 receive 12 volts direct current, with terminal 1111 being positive and terminal 1112 being negative. Terminal 1113 receives a signal from the left inboard proximity switch, terminal 1114 receives a signal from the both center proximity switches, and terminal 1115 receives a signal from the right inboard proximity switch. These signals are inverted from the proximity switch signals previously discussed coming respectively from block 201, the output of AND gate 445 and block R201. Terminal 1116 is a ground terminal, and terminal 1117 at the lower right receives 18 volts D.C. Terminals 1118 and 1119 receive 230 volts of alternating current.

The transformer 1120 and the diodes 1121 and 1122 rectify the alternating current from terminals 1118 and 1119. The signals from terminals 1113, 1114 and 1115 are amplified by the amplifiers 1122, 1123 and 1124. These signals are applied by transistors 1125, 1126 and 1127 to the coils of solenoid valves 1008, 1006 and 1004. Thus, when the clamps leave the left, right and center inboard stations, the valves 1008, 1006 and 1004 are energized to apply high pressure to the clamps in accordance with the previous description.

Switches 1128, 1129 and 1130 are operator controlled, and when they are closed, they energize the coils of valves 1007, 1005 and 1003. These valves cause the clamps to open and close, and the energized condition opens the clamps. For example, when valve 1003 is energized, passage 1150 connects line 1025 to line 1151. This applies pressure to the upper side of the cylinders 1010 and 1011 causing the clamps to open. Lines 1152 and 1153 do the same thing for the other clamps. Normally the clamps are opened automatically as previously described by outputs to blocks 256, 256M and 256R.

We claim:

1. In an apparatus having:

a conveyor for receiving laundry flat pieces;

clamps at the entry side of the apparatus for releasably gripping a laundry flat piece at adjacent corners along a top edge thereof;

means for moving the clamps apart laterally to spread the laundry flat piece along its top edge;

means for actuating said clamps to release the laundry flat piece onto the conveyor after it has been spread apart along its top edge;

and spreader means below said clamps at the entry side of the conveyor for engaging and spreading laterally the laundry flat piece below its top edge;

the improvement which comprises:

means for moving said conveyor to an extended position beyond said clamps and said spreader means at the entry side of the apparatus to facilitate hand feeding of small laundry flat pieces directly onto the conveyor without engagement by said clamps and said spreader means;

and means operable when the conveyor is in said extended position to disable said clamp moving means and spreader means.

2. An apparatus according to claim 1, and further comprising:

means for moving said conveyor from said extended position to a retracted position behind said clamps and said spreader means;

and means operable in said retracted position of said conveyor to enable said clamp moving means and said spreader means to spread a laundry flat piece.

3. An apparatus according to claim 2, and further comprising:

means for discharging air at the top of the laundry flat piece, upon its release by said clamps, to blow the laundry flat piece onto said conveyor;

and means for enabling said air discharging means to operate in said retracted position of the conveyor and for disabling said air discharging means from operating in said extended position of the conveyor.

4. An apparatus according to claim 2 and having:

upstanding end cabinets at the opposite lateral ends of the conveyor;

a top carriage overlying said conveyor and slidably mounted on said end cabinets for selective adjustment longitudinally of the conveyor between a first position toward the entry side of the apparatus and a retracted position away from the entry side of the apparatus;

and further comprising means acting between said top carriage and said conveyor for moving the conveyor to its extended position when the top carriage is in its retracted position and for moving the conveyor to its retracted position when the top carriage is in its first position.

5. An apparatus according to claim 4, and further comprising:

means for discharging air at the top of the laundry flat piece, upon its release by said clamps, to blow the laundry flat piece onto said conveyor;

and means acting between said top carriage and said air discharging means to suspend the latter below the top carriage for movement in unison with the top carriage longitudinally of the conveyor;

and means for enabling said air discharging means to operate in said retracted position of the conveyor and for disabling said air discharging means from operating in said extended position of the conveyor.

6. An apparatus according to claim 1, wherein said conveyor comprises a plurality of horizontal rollers extending from side to side at different locations in the apparatus and flexible endless belts extending across said rollers, said rollers including a front roller at the entry side of the apparatus, and further comprising:

said means for moving said conveyor to said extended position comprises pneumatic cylinder-and-piston means operatively coupled to said front roller for positioning it longitudinally of the conveyor.

7. An apparatus according to claim 6, wherein said rollers include a lower roller engaging said belts from above, and means yieldably biasing said lower roller downward and permitting upward displacement of the lower roller when said cylinder-and-piston means moves said front roller to said extended position thereof.

8. In an apparatus having:

a conveyor for receiving laundry flat pieces; clamps at the entry side of the apparatus for releasably gripping a laundry flat piece at adjacent corners along a top edge thereof;

means for moving the clamps apart laterally to spread the laundry flat piece along its top edge;

means for actuating said clamps to release the laundry flat piece onto the conveyor after it has been spread apart along its top edge;

and two pairs of endless, flexible, motor-driven spreader belts respectively extending in opposite directions laterally outward from the longitudinal centerline of the conveyor below said clamps at the entry side of the apparatus, the belts of each pair running contiguous to each other laterally outward for spreading a laundry flat piece engaged between them;

the improvement wherein at least one belt of each pair has outwardly projecting bristles for engaging the laundry flat piece wherein both belts of each pair have outwardly projecting bristles for engaging the laundry flat piece and further comprising a respective safety switch means operatively associated with each pair of spreader belts to detect the presence between them of an object substantially thicker than a laundry flat piece, and means for stopping the spreader belts in response to the actuation of either of said safety switch means.

9. In an apparatus having:

a conveyor for receiving laundry flat pieces;

clamps at the entry side of the apparatus for releasably gripping a laundry flat piece at adjacent corners along a top edge thereof;

means for moving the clamps apart laterally to spread the laundry flat piece along its top edge;

means for actuating said clamps to release the laundry flat piece onto the conveyor after it has been spread apart along its top edge;

and two pairs of endless flexible spreader belts located respectively on opposite sides of the longitudinal centerline of the conveyor below said clamps, and drive means for moving the belts of each pair contiguous to each other laterally outward from said centerline for spreading a laundry flat piece engaged between them;

the improvement which comprises:

a respective safety switch means operatively associated with each pair of spreader belts for detecting the insertion between them of part of a person's hand;

and means for stopping the spreader belts in response to the actuation of either of said safety switch means each safety switch means being located near the laterally inward end of the respective pair of spreader belts.

10. An apparatus according to claim 9, wherein each safety switch means comprises:

a plate in a position extending behind one of the spreader belts of the corresponding pair near its laterally inward end;

and a switch operatively coupled to said plate to be actuated by the displacement of the plate away from said position.

11. In an apparatus having:

a conveyor for receiving laundry flat pieces;

and means at the entry side of the apparatus for suspending a laundry flat piece from a top edge thereof and for laterally spreading the suspended laundry flat piece before depositing it on the conveyor;

the improvement which comprises:

variable speed drive means for said conveyor:

a pair of trailing edge sensors positioned at different levels below said suspending and spreading means, each of said sensors being operative to sense the upward passage of the bottom edge of the laundry flat piece deposited on the conveyor;

and selector switch means operatively connected to said sensors to enable one of said sensors and disable the other, depending upon the speed at which the conveyor is being driven by said drive means.

12. An apparatus according to claim 11, wherein each of said trailing edge sensors is vertically adjustable.

13. An apparatus according to claim 11 and further comprising circuit means acting between said selector switch means and said spreading means for initiating the latter's spreading action on a laundry flat piece after a time delay following the actuation of the enabled trailing edge sensor by the upward passage of the bottom edge of the preceding laundry flat piece.

14. In an apparatus having:

a conveyor for receiving laundry flat pieces;

clamps at the entry side of the apparatus for releasably gripping a laundry flat piece at adjacent corners along a top edge thereof;

means for moving the clamps apart laterally to spread the laundry flat piece along its top edge;

means for actuating said clamps to release the laundry flat piece onto the conveyor after it has been spread apart along its top edge;

and spreader means below said clamps at the entry side of the conveyor for engaging and spreading laterally the laundry flat piece below its top edge;

the improvement which comprises:

variable speed drive means for said conveyor;

a pair of trailing edge sensors positioned at different levels below said clamps, with each of said sensors being operative to sense the upward passage of the bottom edge of the laundry flat piece deposited on the conveyor;

and selector switch means operatively connected to said sensors to enable one of said sensors and disable the other, depending upon the speed at which the conveyor is being driven by said drive means.

15. An apparatus according to claim 14, wherein each of said trailing edge sensors is vertically adjustable.

16. An apparatus according to claim 14 and further comprising circuit means acting between said selector switch means and said means for moving the clamps apart for initiating the latter's action on a laundry flat piece after a time delay following the acutation of the enabled trailing edge sensor by the upward passage of the bottom edge of the preceeding laundry flat piece.

17. The apparatus according to claim 14 and further including switch means operated by the arrival of one of said clamps at a position close to the center line of the conveyor for stopping the clamps at the respective positions thereof at the center line of the conveyor before the clamps are spread apart.

18. An apparatus according to claim 17 wherein said switch means is a proximity switch operated by said one clamp.

19. An apparatus according to claim 17 wherein said conveyor comprises a plurality of laterally spaced, endless, flexible lower conveyor belts and a plurality of laterally spaced, endless, flexible conveyor belts closely overlying said lower conveyor belts for a portion of their extent away from the entry side of the apparatus, whereby to sandwich the laundry flat piece between the upper and lower conveyor belts as it is conveyed into the apparatus.

20. An apparatus according to claim 19 and further including:

means for moving said conveyor to an extended position beyond said clamps and said spreader means at the entry side of the apparatus to facilitate hand feeding of small laundry flat pieces directly into the conveyor without engagement by said clamps and said spreader means;

and means operable when the conveyor is in said extended position to disable said clamp moving means and spreader means.

21. An apparatus according to claim 20 and further comprising:

means for moving said conveyor from said extended position to a retracted position behind said clamps on said spreader means;

and means operable in said retracted position of said conveyor to enable said clamp moving means and said spreader means to spread a laundry flat piece.

22. An apparatus according to claim 21, and further comprising:

means for discharging air at the top of the laundry flat piece, upon its release by said clamps, to blow the laundry flat piece onto said conveyors;

and means for enabling said air discharging means to operate in said retracted position of the conveyor and for disabling said air discharging means from operating in said extended position of the conveyor.

23. An apparatus according to claim 22 and having:

upstanding end cabinets at the opposite lateral ends of the conveyor;

a top carriage overlying said conveyor and slidably mounted on said end cabinets for selective adjustment longitudinally of the conveyor between a first position toward the entry side of the apparatus and a retracted position away from the entry side of the apparatus;

and further comprising:

means acting between said top carriage and said conveyor for moving the conveyor to its extended position when the top carriage is in its retracted position and for moving the conveyor to its retracted position when the top carriage is in its first position.

24. An apparatus according to claim 23 wherein said spreader means includes two pairs of endless, flexible, motor driven spreader belts respectively extending in opposite directions laterally outward from the longitudinal center line of the conveyor below said clamps at the entry side of the apparatus, the belts of each pair running contiguous to each other laterally outward for spreading a laundry flat piece engaged between them; the improvement wherein at least one belt of each pair has outwardly projecting bristles for engaging the laundry flat piece.

25. An apparatus according to claim 24 and further comprising:

a respective safety switch means operatively associated with each pair of spreader belts to detect the presence between them of an object substantially thicker than a laundry flat piece, and means for stopping the spreader belts in response to the actuation of either of said safety switch means.

26. An apparatus according to claim 25 wherein said air discharge means has laterally spaced air discharge openings shaped to project vertically narrow, horizontally thin-shaped laterally diverging streams of air which merge with each other to form a continuous blanket of air flowing above the conveyor.

27. An apparatus according to claim 26, wherein said air discharge means comprises a plurality of horizontally elongated pipes positioned in succession laterally of the conveyor, and a plurality of air discharge nozzles on said pipes which define said air discharge openings.

28. An apparatus according to claim 14 including means to selectively apply high and low pressure to said clamps.

29. In an apparatus having;

a conveyor for receiving flat pieces;

clamps at the entry side of the apparatus for releasable gripping a flat piece at adjacent corners along a top edge thereof;

means for moving the clamps apart laterally to spread the laundry flat piece along its top edge;

and actuating means for actuating said clamps to release the flat piece onto the conveyor after it has been spread apart along its top edge;

the improvement wherein;

said actuating means includes means to selectively apply high and low pressure to said clamp so that when said clamps are stationary at rest positions low pressure is applied thereto, and when said clamps are moved by said moving means high pressure is applied thereto.

* * * * *